US009710998B2

(12) United States Patent
Nelson et al.

(10) Patent No.: US 9,710,998 B2
(45) Date of Patent: Jul. 18, 2017

(54) GAMING SYSTEM AND METHOD PROVIDING A SLOT GAME INCLUDING A PARTIAL REEL RE-SPIN FEATURE

(71) Applicant: IGT, Las Vegas, NV (US)

(72) Inventors: Dwayne R. Nelson, Las Vegas, NV (US); Johnny L. Palchetti, Henderson, NV (US); Cameron A. Filipour, Las Vegas, NV (US)

(73) Assignee: IGT, Las Vegas, NV (US)

( * ) Notice: Subject to any disclaimer, the term of this patent is extended or adjusted under 35 U.S.C. 154(b) by 52 days.

(21) Appl. No.: 14/258,635

(22) Filed: Apr. 22, 2014

(65) Prior Publication Data

US 2015/0302703 A1 Oct. 22, 2015

(51) Int. Cl.
*A63F 9/00* (2006.01)
*G07F 17/32* (2006.01)

(52) U.S. Cl.
CPC ..... *G07F 17/3211* (2013.01); *G07F 17/3213* (2013.01); *G07F 17/3262* (2013.01)

(58) Field of Classification Search
None
See application file for complete search history.

(56) References Cited

U.S. PATENT DOCUMENTS 5,722,891 A 3/1998 Inoue
6,241,607 B1 6/2001 Payne et al.
6,375,570 B1 4/2002 Poole
6,394,902 B1 5/2002 Glavich et al.
6,413,162 B1 7/2002 Baerlocher et al.
6,443,452 B1 9/2002 Brune
6,461,241 B1 10/2002 Webb et al.
6,464,582 B1 10/2002 Baerlocher et al.
6,561,900 B1 5/2003 Baerlocher et al.
6,604,740 B1 * 8/2003 Singer ..... G07F 17/3262 273/143 R
6,634,945 B2 10/2003 Glavich et al.
6,672,960 B1 1/2004 B-Jensen
6,676,512 B2 1/2004 Fong et al.
6,731,313 B1 5/2004 Kaminkow
6,896,617 B2 5/2005 Daly
6,905,405 B2 6/2005 McClintic
6,910,962 B2 6/2005 Marks et al.
6,913,532 B2 7/2005 Baerlocher et al.
(Continued)

*Primary Examiner* — Seng H Lim
(74) *Attorney, Agent, or Firm* — Neal, Gerber & Eisenberg LLP

(57) ABSTRACT

The present disclosure provides a gaming system and method providing a slot game including a partial reel re-spin feature. Generally, for a play of the slot game in various embodiments, the gaming system displays a randomly determined plurality of symbols of a first set of symbols at a plurality of symbol display areas and makes an award determination based on the displayed symbols. Upon an occurrence of a triggering event, such as the display of a triggering symbol, the gaming system selects a designated set of a plurality of the symbol display areas and replaces the symbols of the first set of symbols displayed at the symbol display areas of the designated set with symbols from a second set of symbols, which may be the same as or different than the first set of symbols. The gaming system makes another award determination based on the displayed symbols.

26 Claims, 25 Drawing Sheets

(56) References Cited

U.S. PATENT DOCUMENTS 6,955,600 B2 10/2005 Glavich et al.
6,997,804 B2 2/2006 Berman
7,056,213 B2 6/2006 Ching et al.
7,066,814 B2 6/2006 Glavich et al.
7,074,127 B2 7/2006 Cuddy et al.
7,090,580 B2 8/2006 Rodgers et al.
7,094,148 B2 8/2006 Baerlocher et al.
7,121,942 B2 10/2006 Baerlocher
7,258,611 B2 8/2007 Bigelow, Jr. et al.
7,322,887 B2 1/2008 Belger et al.
7,351,144 B2 4/2008 Daly
7,371,168 B2 5/2008 Bilyeu et al.
7,371,170 B2 5/2008 Cregan et al.
7,381,134 B2 6/2008 Cuddy et al.
7,402,102 B2 7/2008 Marks et al.
7,473,174 B2 1/2009 Cuddy et al.
7,513,826 B2 4/2009 Cuddy
7,591,724 B2 9/2009 Baerlocher
7,601,062 B2 10/2009 Cole et al.
7,611,406 B2 11/2009 Fuller
7,666,083 B2 2/2010 Baerlocher et al.
7,682,246 B2 3/2010 Cregan et al.
7,690,982 B2 4/2010 Cuddy
7,749,063 B2 7/2010 Belger et al.
7,753,773 B2 7/2010 Baerlocher et al.
7,914,376 B2 3/2011 Walker et al.
7,950,994 B2 5/2011 Berman et al.
8,021,226 B2 9/2011 Souza et al.
8,033,903 B2 10/2011 Cregan
8,105,151 B2 1/2012 Caputo et al.
8,113,942 B2 2/2012 Hoffman et al.
8,113,952 B2 2/2012 Nelson
8,142,274 B2 3/2012 Baerlocher
8,162,741 B2 4/2012 Wadleigh et al.
8,197,335 B2 6/2012 DeWaal et al.
8,221,206 B2 7/2012 Marks et al.
8,231,456 B2 7/2012 Zielinski
8,262,455 B2 9/2012 Caputo et al.
8,277,305 B2 10/2012 Caputo et al.
8,287,364 B2 10/2012 Caputo et al.
8,323,091 B2 12/2012 Frank et al.
8,366,538 B1 2/2013 Saunders et al.
8,414,380 B2 * 4/2013 Saunders ..... G07F 17/32 463/11
8,485,901 B2 * 7/2013 Saunders ..... G07F 17/326 463/16
2002/0119814 A1 8/2002 Fong et al.
2004/0048646 A1 * 3/2004 Visocnik ..... G07F 17/32 463/16
2005/0054418 A1 3/2005 Baerlocher
2005/0059478 A1 3/2005 Peterson et al.
2005/0075162 A1 * 4/2005 Duhamel ..... G07F 17/32 463/20
2006/0258422 A1 11/2006 Walker et al.
2007/0021177 A1 * 1/2007 Yokoyama ..... G07F 17/3211 463/16
2008/0045313 A1 * 2/2008 Yoshizawa ..... G07F 17/34 463/20
2008/0090636 A1 * 4/2008 Lathrop ..... G07F 17/34 463/20
2009/0075722 A1 * 3/2009 Louie ..... G07F 17/32 463/20
2009/0104958 A1 4/2009 Jackson
2009/0124347 A1 5/2009 Rodgers et al.
2009/0197664 A1 8/2009 Schultz
2010/0029364 A1 2/2010 Zielinski
2010/0120507 A1 5/2010 Rodgers et al.
2010/0124970 A1 5/2010 Pawloski et al.
2010/0124972 A1 5/2010 Rodgers et al.
2010/0298042 A1 * 11/2010 Berman ..... G07F 17/34 463/20
2011/0105218 A1 * 5/2011 Anderson ..... G07F 17/32 463/20
2011/0111825 A1 5/2011 Caputo
2012/0115578 A1 5/2012 Caputo et al.
2012/0122547 A1 * 5/2012 Aoki ..... G07F 17/34 463/20
2012/0172106 A1 7/2012 Caputo et al.
2013/0053128 A1 2/2013 Spark-Stahl et al.
2013/0143635 A1 6/2013 Arora et al.
2013/0210512 A1 8/2013 Meyer
2013/0316782 A1 11/2013 Daniels
2014/0087821 A1 3/2014 Zoltewicz et al.
2014/0094271 A1 * 4/2014 Wabschall ..... G07F 17/3267 463/25
2014/0235319 A1 * 8/2014 Meyer ..... G07F 17/326 463/20
2014/0349737 A1 * 11/2014 Meyer ..... G07F 17/326 463/20
2015/0087382 A1 * 3/2015 Gilbertson ..... G07F 17/34 463/20

* cited by examiner 965a
965b
965c
7
BAR
BAR
BAR

GAMING SYSTEM AND METHOD PROVIDING A SLOT GAME INCLUDING A PARTIAL REEL RE-SPIN FEATURE

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in larger awards being provided when they do occur.

For such known gaming systems, an amount of a wager placed on a primary game by a player may vary. For instance, a gaming system may enable a player to wager a minimum quantity of credits, such as one credit (e.g., in monetary currency, one penny, nickel, dime, quarter, or dollar; in non-monetary currency, one point, credit, coin, token, free play credit, or virtual buck), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Various players continually seek out new and different variations to gaming systems. A continuing need thus exists for gaming systems and methods that provide new, exciting, and engaging games.

SUMMARY

Various embodiments of the present disclosure provide a gaming system and method providing a slot game including a partial reel re-spin feature. Generally, for a play of the slot game in various embodiments, the gaming system displays a randomly determined plurality of symbols of a first set of symbols at a plurality of symbol display areas (such as by displaying a first set of reels spinning and stopping in association with the symbol display areas). The gaming system makes an award determination based on the displayed symbols. Upon an occurrence of a triggering event (such as the display of a triggering symbol), the gaming system selects a designated set of a plurality of the symbol display areas (such as based on a proximity of those symbol display areas to the triggering symbol), and replaces the symbols of the first set of symbols displayed at the symbol display areas of the designated set with symbols from a second set of one or more symbols (such as by displaying a second set of reels spinning and stopping in association with the symbol display areas of the designated set). The gaming system makes another award determination based on the displayed symbols.

More specifically, in operation of one embodiment, for a play of the slot game, the gaming system displays a plurality of symbol display areas and, for each symbol display area, displays a randomly determined symbol of a first set of a plurality of symbols at that symbol display area by displaying a first set of reels spinning and stopping in association with the symbol display areas. In this embodiment, the first set of symbols includes a triggering symbol. The gaming system determines any awards based on the displayed symbols and displays any determined awards. The gaming system determines if the triggering symbol is displayed at one of the symbol display areas. If the gaming system determines that the triggering symbol is not displayed at any of the symbol display areas, the gaming system ends the play of the slot game. If, on the other hand, the gaming system determines that the triggering symbol is displayed at one of the symbol display areas, the gaming system provides the partial reel re-spin feature, described below.

More specifically, if the gaming system determines that the triggering symbol is displayed at one of the symbol display areas, the gaming system determines a designated set of a plurality of the symbol display areas. In this embodiment, the gaming system does so based at least in part on a proximity of each other symbol display area to the symbol display area at which that triggering symbol is displayed. Put differently, the gaming system uses the location of each other symbol display area relative to the symbol display area at which that triggering symbol is displayed to (at least in part) determine which of the other symbol display areas to include in the designated set of the symbol display areas.

For each symbol display area of the designated set of the symbol display areas, the gaming system replaces the symbol of the first set of symbols displayed at that symbol display area with a randomly determined symbol of a second set of one or more symbols, which may be the same as or different than the first set of symbols. In this embodiment, the gaming system does so by determining a second set of reels each including a plurality of the second set of symbols and displaying the second set of reels spinning and stopping in association with the symbol display areas of the designated set. The gaming system determines any awards based on the displayed symbols and displays any determined awards. The gaming system then ends the play of the slot game.

It should thus be appreciated that the gaming system and method of the present disclosure provide a new game to increase player engagement, enjoyment, entertainment, and excitement.

Additional features and advantages are described herein, and will be apparent from, the following Detailed Description and the Figures.

DETAILED DESCRIPTION

Slot Game Including a Partial Reel Re-Spin Feature

Various embodiments of the present disclosure provide a gaming system and method providing a slot game including a partial reel re-spin feature. Generally, for a play of the slot game in various embodiments, the gaming system displays a randomly determined plurality of symbols of a first set of symbols at a plurality of symbol display areas (such as by displaying a first set of reels spinning and stopping in association with the symbol display areas). The gaming system makes an award determination based on the displayed symbols. Upon an occurrence of a triggering event (such as the display of a triggering symbol) the gaming system selects a designated set of a plurality of the symbol display areas, and replaces the symbols of the first set of symbols displayed at the symbol display areas of the designated set with symbols from a second set of one or more symbols (such as by displaying a second set of reels spinning and stopping in association with the symbol display areas of the designated set). The gaming system makes another award determination based on the displayed symbols.

Although the slot game is described as a primary wagering game in the embodiments described herein, it should be appreciated that the slot game of the present disclosure may additionally or alternatively be implemented as a bonus or secondary game. Further, while any credit balances, any wagers, and any awards are displayed as amounts of monetary currency or credits, one or more of such credit balances, such wagers, and such awards may be for any suitable non-monetary credits or currency, promotional credits, and/or player tracking points or credits.

Figure 1:
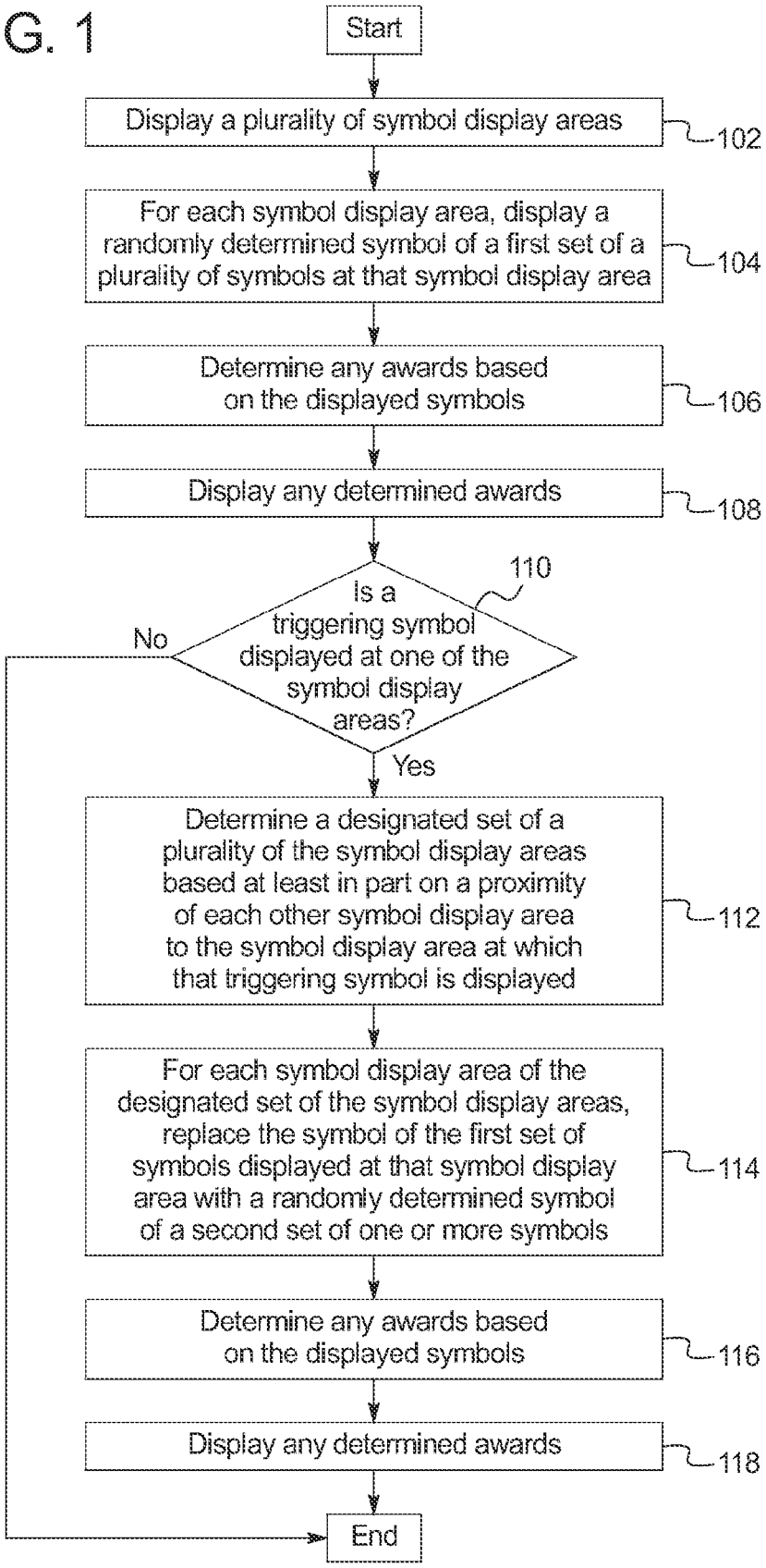
FIG. 1 is a flowchart illustrating an example method of operating one embodiment of the gaming system of the present disclosure.

FIG. 1 illustrates a flowchart of an example process or method 100 of operating one embodiment of the gaming system of the present disclosure. In various embodiments, the process 100 is represented by a set of instructions stored in one or more memories and executed by one or more processors. Although the process 100 is described with reference to the flowchart shown in FIG. 1, it should be appreciated that many other processes of performing the acts associated with this illustrated process 100 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the process 100 begins upon initiation of a play of the slot game including the partial reel re-spin feature. The gaming system displays a plurality of symbol display areas, as indicated by block 102. For each symbol display area, the gaming system displays a randomly determined symbol of a first set of a plurality of symbols at that symbol display area (such as by displaying a first set of reels spinning and stopping in association with the symbol display areas), as indicated by block 104. In this example embodiment, the first set of symbols includes a triggering symbol. The gaming system determines any awards based on the displayed symbols, as indicated by block 106, and displays any determined awards, as indicated by block 108. The gaming system determines if the triggering symbol is displayed at one of the symbol display areas, as indicated by diamond 110.

If the gaming system determines that the triggering symbol is not displayed at any of the symbol display areas, the process 100 (and, in this example embodiment, the play of the slot game) ends. If, on the other hand, the gaming system determines that the triggering symbol is displayed at one of the symbol display areas, the gaming system provides the partial reel re-spin feature. More specifically, if the gaming system determines that the triggering symbol is displayed at one of the symbol display areas, the gaming system determines a designated set of a plurality of the symbol display areas, as indicated by block 112. The gaming system does so based at least in part on a proximity of each other symbol display area to the symbol display area at which that triggering symbol is displayed. Put differently, the gaming system uses the location of each other symbol display area relative to the symbol display area at which that triggering symbol is displayed to (at least in part) determine which of the other symbol display areas to include in the designated set of the symbol display areas.

For each symbol display area of the designated set of the symbol display areas, the gaming system replaces the symbol of the first set of symbols displayed at that symbol display area with a randomly determined symbol of a second set of one or more symbols (such as by displaying a second set of reels spinning and stopping in association with the symbol display areas of the designated set), as indicated by block 114. The second set of symbols may be the same as, or different than, the first set of symbols. The gaming system determines any awards based on the displayed symbols, as indicated by block 116, and displays any determined awards, as indicated by block 118. The process 100 (and, in this example embodiment, the play of the slot game) then ends.

FIGS. 2A, 2B, 2C, 2D, 2E, and 2F illustrate screen shots of one example embodiment of the gaming system of the present disclosure providing the slot game having the partial reel re-spin feature.

In this example embodiment, the gaming system displays, such as on a display device 1116 (described below), a plurality of symbol display areas 210*a*, 210*b*, 210*c*, 210*d*, 210*e*, 210*f*, 210*g*, 210*h*, 210*i*, 210*j*, 210*k*, 210*l*, 210*m*, 210*n*, 2100, 210*p*, 210*q*, 210*r*, 210*s*, 210*t*, 210*u*, 210*v*, 210*w*, 210*x*, 210*y*, 210*z*, 210*aa*, 210*bb*, 210*cc*, 210*dd*, 210*ee*, 210*ff*, 210*gg*, 210*hh*, 210*ii*, 210*jj*, 210*kk*, 210*ll*, 210*mm*, 210*nn*, 210*oo*, 210*pp*, 210*qq*, 210*rr*, and 210*ss* arranged in a 9×5 grid or matrix. The gaming system also displays a first set of a plurality of reels 205*a*, 205*b*, 205*c*, 205*d*, and 205*e*, each of which includes a plurality of a first set of a plurality of symbols, in association with the symbol display areas.

More specifically, each reel 205*a*, 205*b*, 205*c*, 205*d*, and 205*e* of the first set of reels is associated with, and configured to display symbols at, a plurality of the symbol display areas. In this example embodiment: (a) the reel 205*a* is associated with, and configured to display symbols at, the symbol display areas 210*a*, 210*f*, 210*k*, 210*p*, 210*u*, 210*z*, 210*ee*, 210*jj*, and 210*oo*; (b) the reel 205*b* is associated with, and configured to display symbols at, the symbol display areas 210*b*, 210*g*, 210*l*, 210*q*, 210*v*, 210*aa*, 210*ff*, 210*kk*, and 210*pp*; (c) the reel 205*c* is associated with, and configured to display symbols at, the symbol display areas 210*c*, 210*h*, 210*m*, 210*r*, 210*w*, 210*bb*, 210*gg*, 210*ll*, and 210*qq*; (d) the reel 205*d* is associated with, and configured to display symbols at, the symbol display areas 210*d*, 210*i*, 210*n*, 210*s*, 210*x*, 210*cc*, 210*hh*, 210*mm*, and 210*rr*; and (e) the reel 205*e* is associated with, and configured to display symbols at, the symbol display areas 210*e*, 210*j*, 2100, 210*t*, 210*y*, 210*dd*, 210*ii*, 210*nn*, and 210*ss*. The slot game is associated with a plurality of paylines (not shown for clarity), each of which is associated with a different plurality of the symbol display areas.

The gaming system also displays: (a) a message box 230 that displays a variety of messages or indications before, during, or after play of the slot game; (b) a plurality of buttons actuatable by the player, including: (i) a Bet Per Line button 231 that, when actuated by the player, causes the gaming system to enable the player to select an amount to bet on each wagered-on payline; (ii) a Select Lines button 232 that, when actuated by the player, causes the gaming system to enable the player to select the paylines on which the player desires to wager for a play of the slot game; (iii) a Menu button 233 that, when actuated by the player, causes the gaming system to display additional information about the slot game, such as the paytable for the slot game and/or the rules of the slot game; (iv) a Max Bet button 234 that, when actuated by the player, causes the gaming system to set the amount bet on each payline to a maximum amount and to set the quantity of paylines on which the player desires to wager to a maximum quantity of the paylines; and (v) a Spin button 235 that, when actuated by the player, causes the gaming system to initiate a play of the slot game; and (c) a plurality of meters including: (i) a bet meter 236 that displays any bet placed on a play of the slot game (in credit or currency form), (ii) a credit meter 237 that displays the player's credit balance (in credit or currency form), and (iii) an award meter 238 that displays any awards won for the play of the primary slot game (in credit or currency form).

As noted above, the slot game has a partial reel re-spin feature. In this example embodiment, the gaming system provides the partial reel re-spin feature when a triggering symbol included in the first set of symbols is displayed at one of the symbol display areas following a spin of the first set of reels (i.e., after the gaming system has displayed the first set of reels spinning and stopping such that a symbol of the first set of symbols is displayed at each of the symbol display areas). In this example embodiment, the triggering symbol is a Dollar Sign symbol, though it should be appreciated that any suitable symbol may be the triggering symbol. In this example embodiment, when the triggering symbol is displayed at one of the symbol display areas following a spin of the first set of reels, the gaming system provides the partial reel re-spin feature by: (a) determining a designated set of a plurality of the symbol display areas based at least in part on a proximity of each other symbol display area to the symbol display area at which that triggering symbol is displayed, (b) replacing the symbols of the first set of symbols displayed at the symbol display areas of the designated set of the symbol display areas with symbols from a second set of one or more symbols, and (c) making an award determination based on the displayed symbols.

More specifically, in this example embodiment, when the triggering symbol is displayed at one of the symbol display areas following a spin of the first set of reels, the gaming system determines and includes the following symbol display areas in the designated set of the symbol display areas associated with that triggering symbol: (a) the symbol display area at which that triggering symbol is displayed, (b) each symbol display area adjacent to the symbol display area at which that triggering symbol is displayed, and (c) each symbol display area diagonally adjacent to the symbol display area at which that triggering symbol is displayed. It should thus be appreciated that the symbol display areas in the designated set of the symbol display areas associated with a particular displayed triggering symbol are determined based on the location of each other symbol display area relative to the symbol display area at which that particular triggering symbol is displayed.

Additionally, in this example embodiment, after determining the designated set of the symbol display areas associated with a particular displayed triggering symbol, the gaming system replaces the symbols of the first set of symbols displayed at the symbol display areas of the designated set of the symbol display areas with symbols from the second set of symbols by: (a) determining a second set of one or more reels, each of which includes a plurality of the symbols of the second set of symbols; (b) for each reel of the second set, associating one of more of the symbol display areas of the designated set of the symbol display areas with that reel such that that reel is configured to display a symbol at each of those symbol display areas; and (c) displaying the reel(s) of the second set spinning and stopping such that a symbol of the second set of symbols is displayed at each symbol display area of the designated set of the symbol display areas.

Figure 2A:
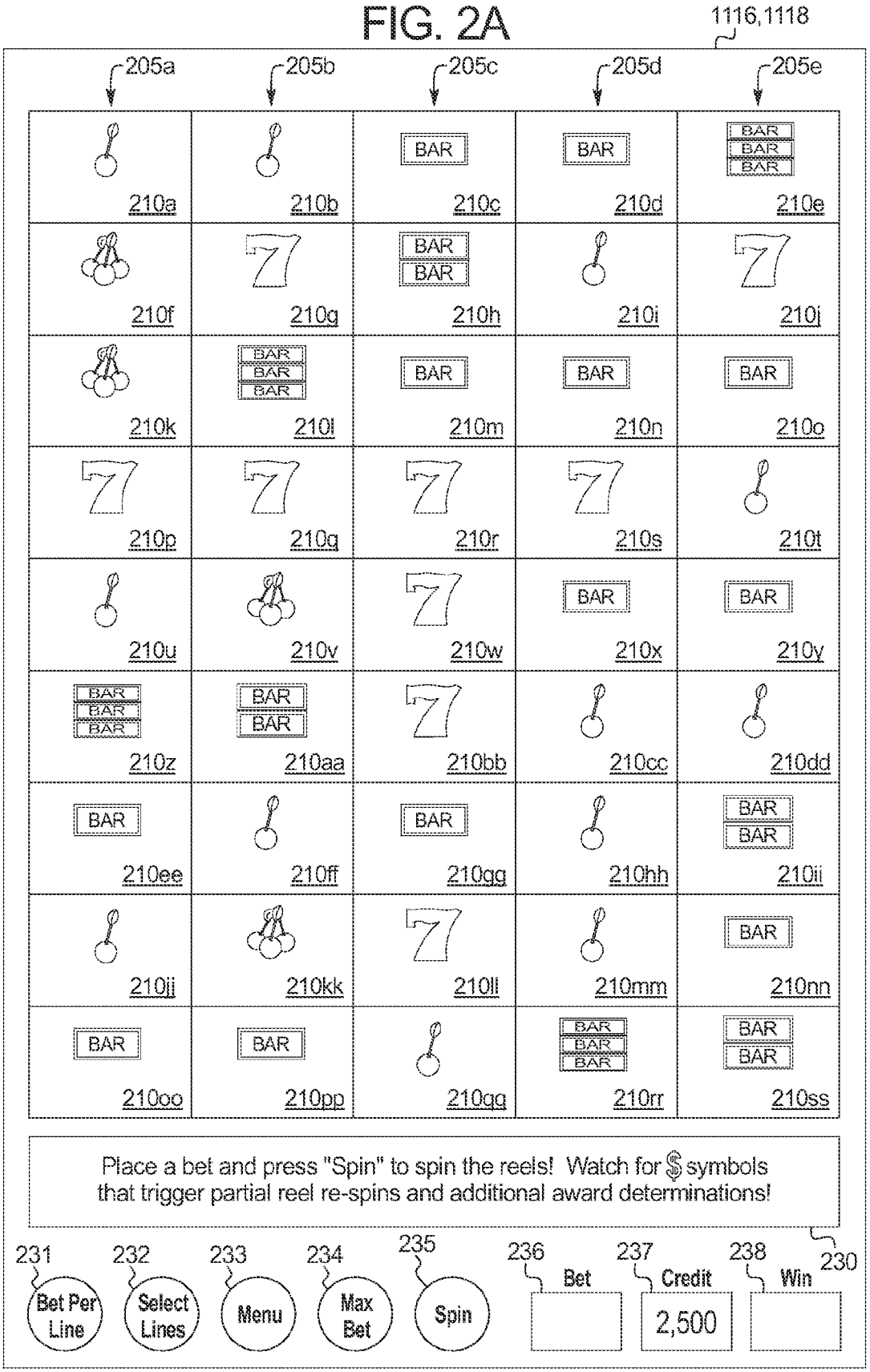
FIGS. 2A, 2B, 2C, 2D, 2E, and 2F illustrate screen shots of one example embodiment of the gaming system of the present disclosure providing the slot game having the partial reel re-spin feature.

Turning to FIG. 2A, the gaming system receives a deposit of value from a player and credits the player with 2,500 credits (as shown in the credit meter 237). The gaming system displays the following message in the message box 230: "PLACE A WAGER AND PRESS 'SPIN' TO SPIN THE REELS! WATCH FOR $ SYMBOLS THAT TRIGGER PARTIAL REEL RE-SPINS AND ADDITIONAL AWARD DETERMINATIONS!"

Figure 2B:
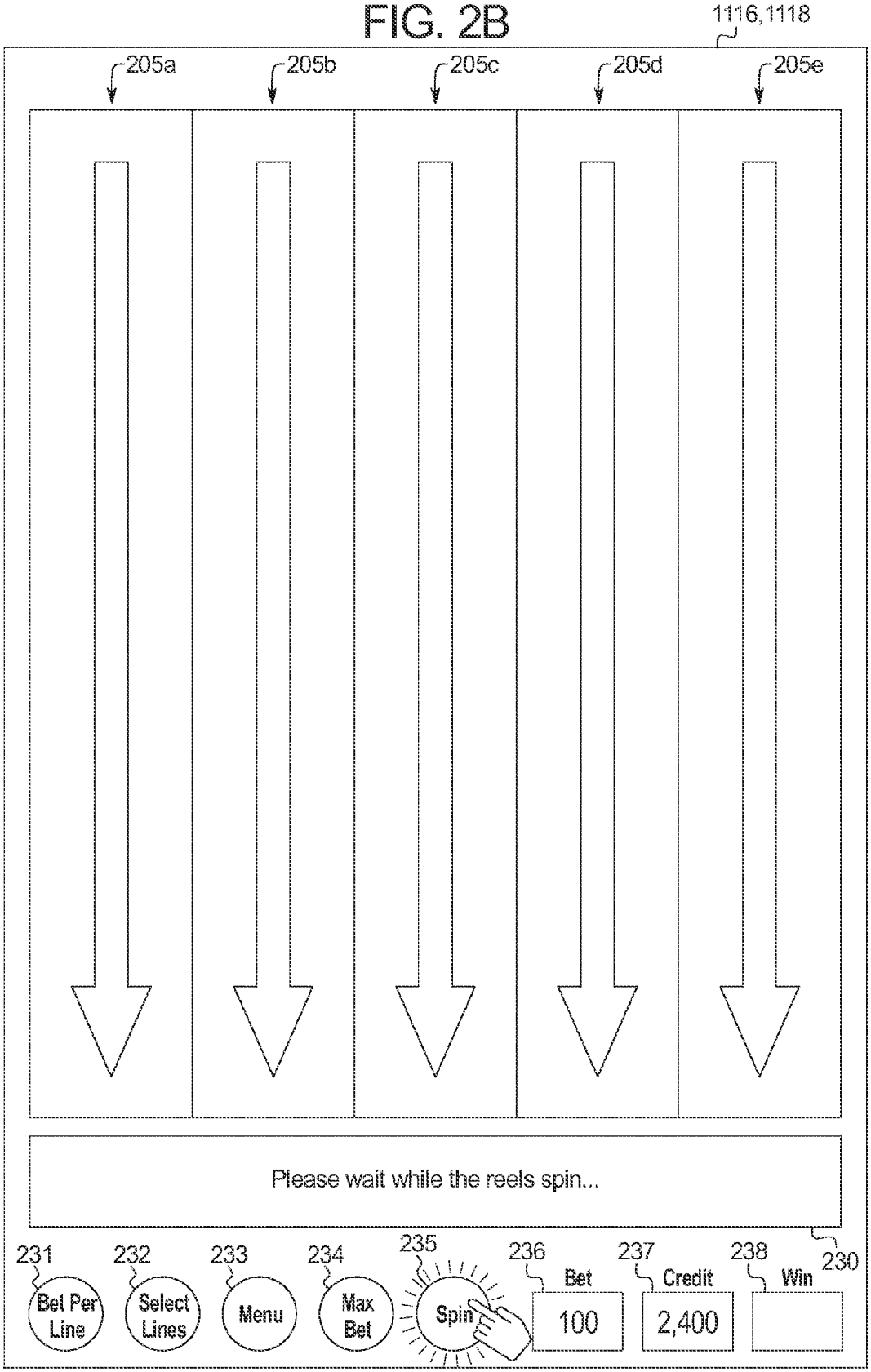

As shown in FIG. 2B, the gaming system receives a bet of 100 credits (as shown in the bet meter 236) and an actuation of the Spin button 235 from the player. Upon receiving the actuation of the Spin button 235, the gaming system reduces the player's credit balance by the 100 credit wager (as shown in the credit meter 237); initiates a play of the slot game; and displays the reels 205*a*, 205*b*, 205*c*, 205*d*, and 205*e* of the first set spinning. The gaming system displays the following message in the message box 230: "PLEASE WAIT WHILE THE REELS SPIN . . . "

Figure 2C:
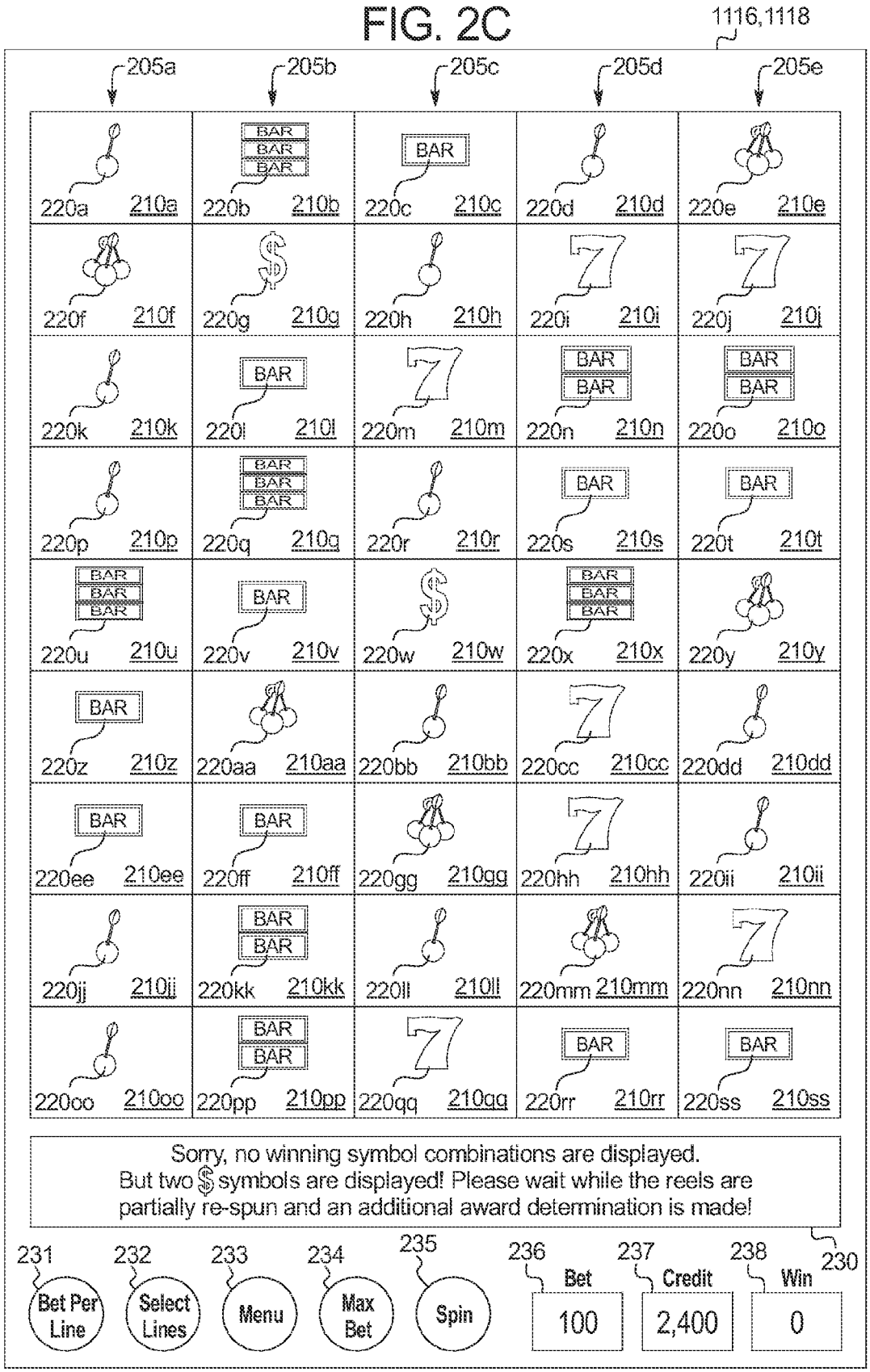

As illustrated in FIG. 2C, the gaming system stops spinning the reels 205*a*, 205*b*, 205*c*, 205*d*, and 205*e* of the first set such that: (a) Cherry symbol 220*a* is displayed at the symbol display area 210*a*, (b) Triple Bar symbol 220*b* is displayed at the symbol display area 210*b*, (c) Bar symbol 220*c* is displayed at the symbol display area 210*c*, (d) Cherry symbol 220*d* is displayed at the symbol display area 210*d*, (e) Triple Cherry symbol 220*e* is displayed at the symbol display area 210*e*, (f) Triple Cherry symbol 220*f* is displayed at the symbol display area 210*f*, (g) Dollar Sign symbol 220*g* is displayed at the symbol display area 210*g*, (h) Cherry symbol 220*h* is displayed at the symbol display area 210*h*, (i) Seven symbol 220*i* is displayed at the symbol display area 210*i*, (j) Seven symbol 220*j* is displayed at the symbol display area 210*j*, (k) Cherry symbol 220*k* is displayed at the symbol display area 210*k*, (l) Bar symbol 220*l* is displayed at the symbol display area 210*l*, (m) Seven symbol 220*m* is displayed at the symbol display area 210*m*, (n) Double Bar symbol 220*n* is displayed at the symbol display area 210*n*, (o) Double Bar symbol 220*o* is displayed at the symbol display area 210*o*, (p) Cherry symbol 220*p* is displayed at the symbol display area 210*p*, (q) Triple Bar symbol 220*q* is displayed at the symbol display area 210*q*, (r) Cherry symbol 220*r* is displayed at the symbol display area 210*r*, (s) Bar symbol 220*s* is displayed at the symbol display area 210*s*, (t) Bar symbol 220*t* is displayed at the symbol display area 210*t*, (u) Triple Bar symbol 220*u* is displayed at the symbol display area 210*u*, (v) Bar symbol 220*v* is displayed at the symbol display area 210*v*, (w) Dollar Sign symbol 220*w* is displayed at the symbol display area 210*w*, (x) Triple Bar symbol 220*x* is displayed at the symbol display area 210*x*, (y) Triple Cherry symbol 220*y* is displayed at the symbol display area 210*y*, (z) Bar symbol 220*z* is displayed at the symbol display area 210*z*, (aa) Triple Cherry symbol 220*aa* is displayed at the symbol display area 210*aa*, (bb) Cherry symbol 220*bb* is displayed at the symbol display area 210*bb*, (cc) Seven symbol 220*ee* is displayed at the symbol display area 210*cc*, (dd) Cherry symbol 220*dd* is displayed at the symbol display area 210*dd*, (ee) Bar symbol 220*ee* is displayed at the symbol display area 210*ee*, (ff) Bar symbol 220*ff* is displayed at the symbol display area 210*ff*, (gg) Triple Cherry symbol 220*gg* is displayed at the symbol display area 210*gg*, (hh) Seven symbol 220*hh* is displayed at the symbol display area 210*hh*, (ii) Cherry symbol 220*ii* is displayed at the symbol display area 210*ii*, (jj) Cherry symbol 220*jj* is displayed at the symbol display area 210*jj*, (kk) Double Bar symbol 220*kk* is displayed at the symbol display area 210*kk*, (ll) Cherry symbol 220*ll* is displayed at the symbol display area 210*ll*, (mm) Triple Cherry symbol 220*mm* is displayed at the symbol display area 210*mm*, (nn) Seven symbol 220*nn* is displayed at the symbol display area 210*nn*, (oo) Cherry symbol 220*oo* is displayed at the symbol display area 210*oo*, (pp) Double Bar symbol 220*pp* is displayed at the symbol display area 210*pp*, (qq) Seven symbol 220*qq* is displayed at the symbol display area 210*qq*, (rr) Bar symbol 220*rr* is displayed at the symbol display area 210*rr*, and (ss) Bar symbol 220*ss* is displayed at the symbol display area 210*ss*.

The gaming system determines any awards associated with the symbols displayed at the symbol display areas by determining whether any winning combinations of the symbols included in the paytable (not shown) associated with the slot game are displayed at the symbol display areas associated with any of the wagered-on paylines (not shown). In this example embodiment, the gaming system determines that no winning symbol combinations are displayed at the symbol display areas associated with any of the wagered-on paylines.

The gaming system determines whether the Dollar Sign symbol (i.e., the triggering symbol in this example embodiment) is displayed at any of the symbol display areas. The gaming system determines that: (a) the Dollar Sign symbol 220*g* is displayed at the symbol display area 210*g*, and (b) the Dollar Sign symbol 220*w* is displayed at the symbol display area 210*w*. The gaming system displays the following message in the message box 230: "SORRY, NO WINNING SYMBOL COMBINATIONS ARE DISPLAYED. BUT TWO $ SYMBOLS ARE DISPLAYED! PLEASE WAIT WHILE THE REELS ARE PARTIALLY RE-SPUN AND AN ADDITIONAL AWARD DETERMINATION IS MADE!"

Figure 2D:
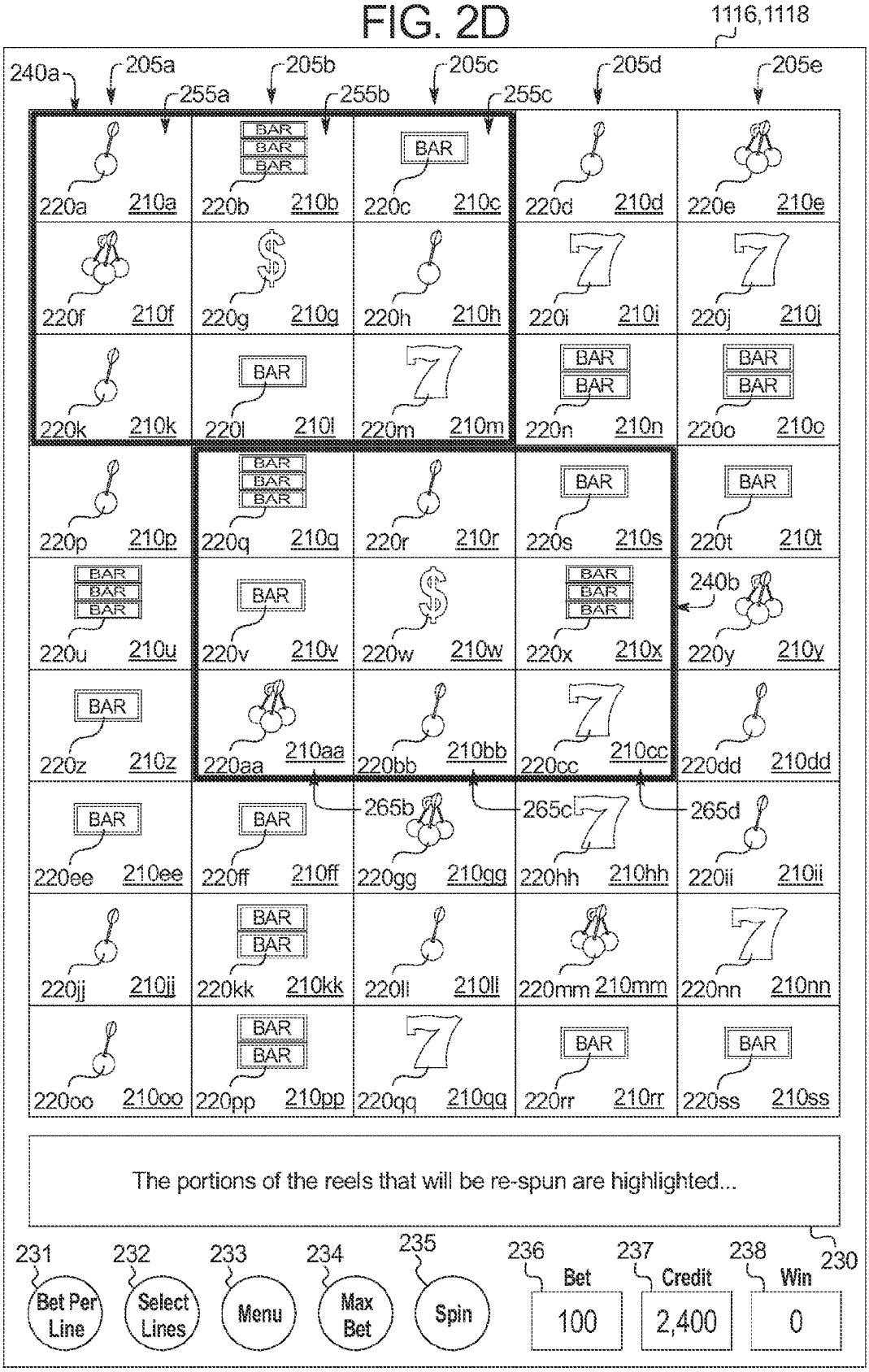

As shown in FIG. 2D, for each displayed triggering symbol, the gaming system determines a designated set of the symbol display areas. Specifically, for the Dollar Sign symbol 220*g*, the gaming system determines a designated set of the symbol display areas 240*a* including: (i) the symbol display area 210*g* (i.e., the symbol display area at which the Dollar Sign symbol 220*g* is displayed); (ii) the symbol display areas 210*b*, 210*f*, 210*h*, and 210*l* (i.e., each symbol display area adjacent to the symbol display area 210*g* at which the Dollar Sign symbol 220*g* is displayed); and (iii) the symbol display areas 210*a*, 210*c*, 210*k*, and 210*m* (i.e., each symbol display area diagonally adjacent to the symbol display area 210*g* at which the Dollar Sign symbol 220*g* is displayed). Similarly, for the Dollar Sign symbol 220*w*, the gaming system determines a designated set of the symbol display areas 240*b* including: (i) the symbol display area 210*w* (i.e., the symbol display area at which the Dollar Sign symbol 220*w* is displayed); (ii) the symbol display areas 210*r*, 210*v*, 210*x*, and 210*bb* (i.e., each symbol display area adjacent to the symbol display area 210*w* at which the Dollar Sign symbol 220*w* is displayed); and (iii) the symbol display areas 210*q*, 210*s*, 210*aa*, and 210*cc* (i.e., each symbol display area diagonally adjacent to the symbol display area 210*w* at which the Dollar Sign symbol 220*w* is displayed). In this example embodiment, the gaming system highlights the designated sets of the symbol display areas 240*a* and 240*b* via a dark border, though it should be appreciated that the gaming system may do so (or not) in any other suitable manner. The gaming system displays the following message in the message box 230: "THE PORTIONS OF THE REELS THAT WILL BE RE-SPUN ARE HIGHLIGHTED . . . .

As explained above, in this example embodiment, after determining the designated sets of the symbol display areas, for each of the designated sets of the symbol display areas, the gaming system determines a second set of reels and associates each reel of the second set of reels with one or more of the symbol display areas of that designated set of the symbol display areas. In this example embodiment, the second set of symbols is the same as the first set of symbols, and each of the reels of the second set of reels includes a plurality of the symbols of the second set of symbols. In this example embodiment, each individual designated set of the symbol display areas is associated with an individual second set of reels.

Specifically, respect to the designated set of the symbol display areas 240*a* associated with the Dollar Sign symbol 220*g*, the gaming system: (a) determines a reel 255*a*, which is the same as the reel 205*a*, and associates the reel 255*a* with the symbol display areas 210*a*, 210*f*, and 210*k* of the designated set of the symbol display areas 240*a* such that the reel 255*a* is configured to display symbols at those symbol display areas; (b) determines a reel 255*b*, which is the same as the reel 205*b*, and associates the reel 255*b* with the symbol display areas 210*b*, 210*g*, and 210*l* of the designated set of the symbol display areas 240*a* such that the reel 255*b* is configured to display symbols at those symbol display areas; and (c) determines a reel 255*c*, which is the same as the reel 205*c*, and associates the reel 255*c* with the symbol display areas 210*c*, 210*h*, and 210*m* of the designated set of the symbol display areas 240*a* such that the reel 255*c* is configured to display symbols at those symbol display areas. Thus, in this example embodiment, the second set of reels associated with the designated set of the symbol display areas 240*a* includes the reels 255*a*, 255*b*, and 255*c*.

With respect to the designated set of the symbol display areas 240*b* associated with the Dollar Sign symbol 220*w*, the gaming system: (a) determines a reel 265*b*, which is the same as the reel 205*b*, and associates the reel 265*b* with the symbol display areas 210*q*, 210*v*, and 210*aa* of the designated set of the symbol display areas 240*b* such that the reel 265*b* is configured to display symbols at those symbol display areas; (b) determines a reel 265*c*, which is the same as the reel 205*c*, and associates the reel 265*c* with the symbol display areas 210*r*, 210*w*, and 210*bb* of the designated set of the symbol display areas 240*b* such that the reel 265*c* is configured to display symbols at those symbol display areas; and (c) determines a reel 265*d*, which is the same as the reel 205*d*, and associates the reel 265*d* with the symbol display areas 210*s*, 210*x*, and 210*cc* of the designated set of the symbol display areas 240*b* such that the reel 265*d* is configured to display symbols at those symbol display areas. Thus, in this example embodiment, the second set of reels associated with the designated set of the symbol display areas 240*b* includes the reels 265*b*, 265*c*, and 265*d*.

It should thus be appreciated that, in this example embodiment, for a particular designated set of the symbol display areas, the second set of reels that the gaming system employs for that designated set of the symbol display areas is the same as the first set of reels the gaming system employed for the symbol display areas of that designated set of the symbol display areas.

Figure 2E:
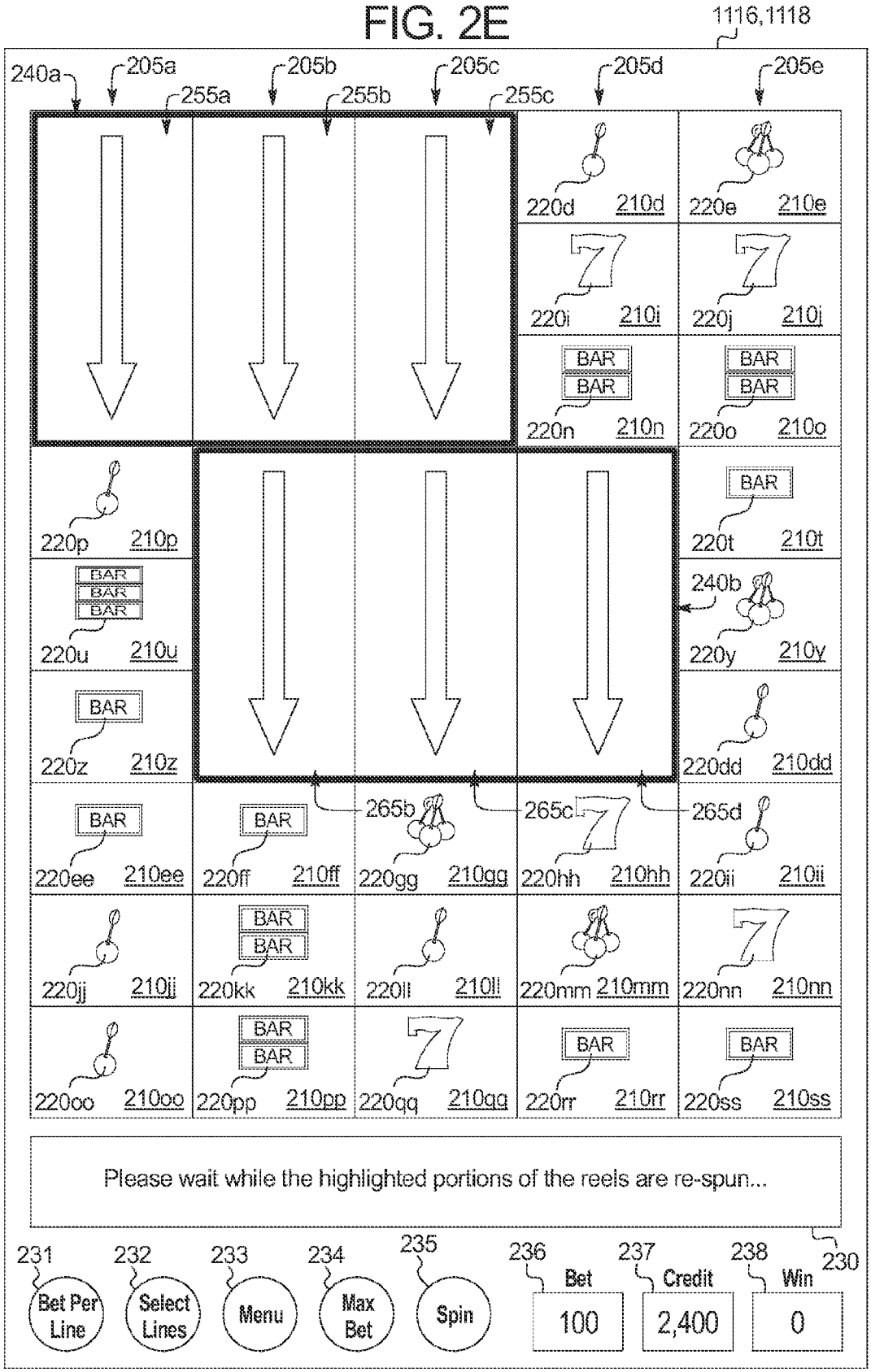

As shown in FIG. 2E, the gaming system: (a) displays the reels 255*a*, 255*b*, 255*c* of the second set of reels associated with the designated set of the symbol display areas 240*a* spinning in association with the designated set of the symbol display areas 240*a*; (b) displays the reels 265*b*, 265*c*, and 265*d* of the second set of reels associated with the designated set of the symbol display areas 240*b* spinning in association with the designated set of the symbol display areas 240*b*; and (c) does not display any reels spinning in association with the symbol display areas not included in any of the designated sets of the symbol display areas. That is, in this example embodiment, the gaming system does not replace any symbols of the first set of symbols displayed at the symbol display areas that are not included in either of the designated sets of the symbol display areas. The gaming system displays the following message in the message box 230: "PLEASE WAIT WHILE THE HIGHLIGHTED PORTIONS OF THE REELS ARE RE-SPUN . . . "

Figure 2F:
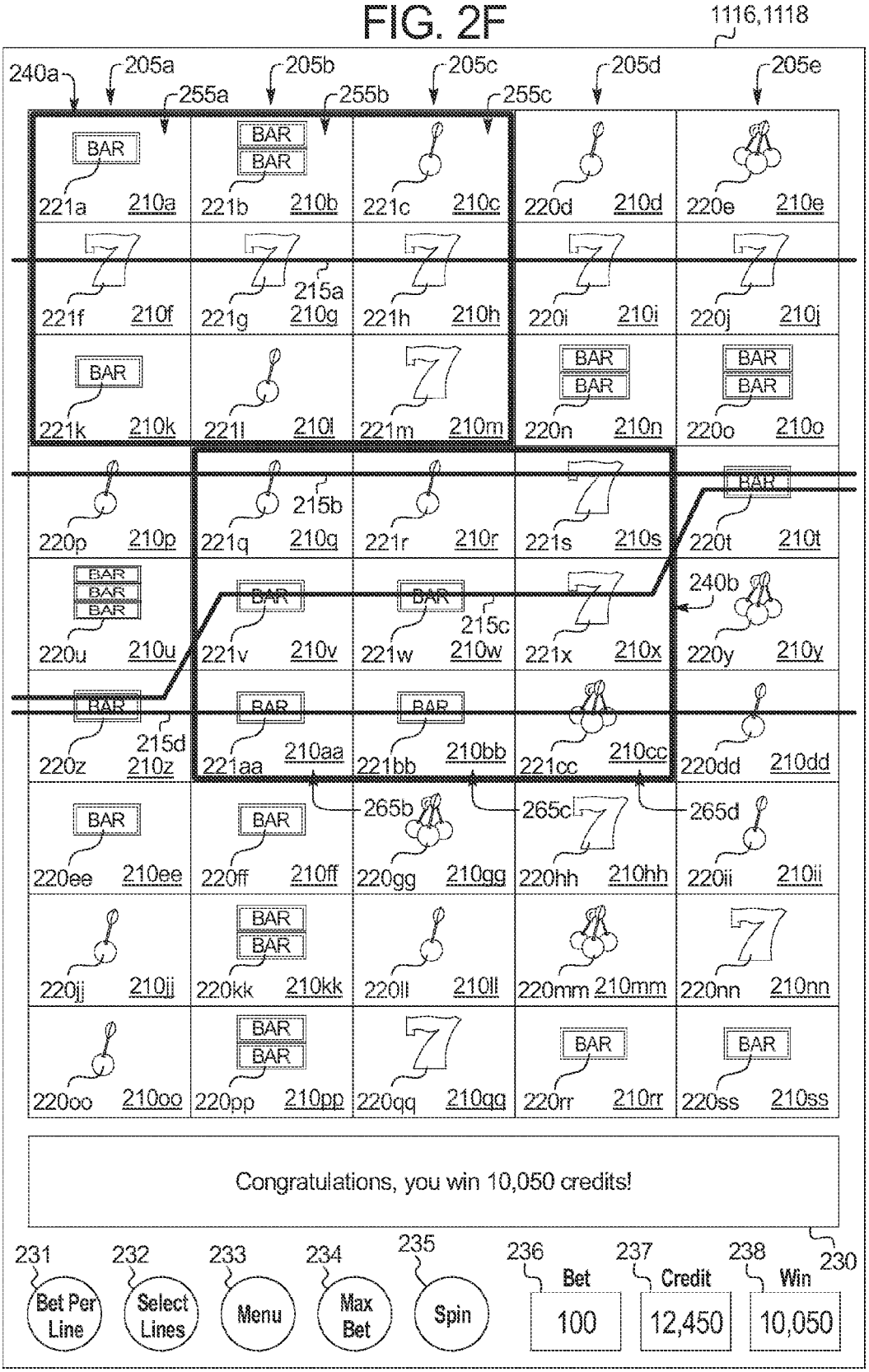

As illustrated in FIG. 2F, with respect to the designated set of the symbol display areas 240*a*, the gaming system stops the reels 255*a*, 255*b*, and 255*c* of the second set of reels associated with the designated set of the symbol display areas 240*a* from spinning such that: (a) the Bar symbol 221*a* is displayed at the symbol display area 210*a*, (b) the Double Bar symbol 221*b* is displayed at the symbol display area 210*b*, (c) the Cherry symbol 221*c* is displayed at the symbol display area 210*c*, (d) the Seven symbol 221*f* is displayed at the symbol display area 210*f*, (e) the Seven symbol 221*g* is displayed at the symbol display area 210*g*, (f) the Seven symbol 221*h* is displayed at the symbol display area 210*h*, (g) the Bar symbol 221*k* is displayed at the symbol display area 210*k*, (h) the Cherry symbol 221*l* is displayed at the symbol display area 210*l*, and (i) the Seven symbol 221*m* is displayed at the symbol display area 210*m*.

Additionally, with respect to the designated set of the symbol display areas 240*b*, the gaming system stops the reels 265*b*, 265*c*, and 265*d* of the second set of reels associated with the designated set of the symbol display areas 240*b* from spinning such that: (a) the Cherry symbol 221*q* is displayed at the symbol display area 210*q*, (b) the Cherry symbol 221*r* is displayed at the symbol display area 210*r*, (c) the Seven symbol 221*s* is displayed at the symbol display area 210*s*, (d) the Bar symbol 221*v* is displayed at the symbol display area 210*v*, (e) the Bar symbol 221*w* is displayed at the symbol display area 210*w*, (f) the Seven symbol 221*x* is displayed at the symbol display area 210*x*, (g) the Bar symbol 221*aa* is displayed at the symbol display area 210*aa*, (h) the Bar symbol 221*bb* is displayed at the symbol display area 210*bb*, and (i) the Triple Cherry symbol 221*cc* is displayed at the symbol display area 210*cc*.

The gaming system determines any awards associated with the symbols displayed at the symbol display areas by determining whether any winning combinations of the symbols included in the paytable associated with the slot game are displayed at the symbol display areas associated with any of the wagered-on paylines. In this example embodiment, the gaming system determines: (a) an award of 10,000 credits associated with the Seven-Seven-Seven-Seven-Seven winning symbol combination displayed at the symbol display areas associated with a payline 215*a*; (b) an award of 30 credits associated with the Cherry-Cherry-Cherry winning symbol combination displayed at the symbol display areas associated with a payline 215*b*; (c) an award of 10 credits associated with the Bar-Bar-Bar winning symbol combination displayed at the symbol display areas associated with a payline 215*c*; and (d) an award of 10 credits associated with the Bar-Bar-Bar winning symbol combination displayed at the symbol display areas associated with a payline 215*d*. The gaming system displays the total award of 10,050 credits in the award meter 238 and updates the player's credit meter 237 to reflect the total award of 10,050 credits.

Variations

It should be appreciated that the gaming system may determine which symbol display areas to include in the designated set of the symbol display areas in any suitable manner.

In various embodiments, upon an occurrence of the triggering event, the gaming system randomly determines which particular symbol display areas to include in the designated set of the symbol display areas. In one such embodiment, a quantity of the symbol display areas to include in the designated set of the symbol display areas is predetermined. In another such embodiment, the gaming system randomly determines the quantity of the symbol display areas to include in the designated set of the symbol display areas.

In certain embodiments, upon an occurrence of the triggering event, the gaming system determines which symbol display areas to include in the designated set of the symbol display areas based at least in part on a proximity of each other symbol display area to a designated one of the symbol display areas (such as a symbol display area displaying a triggering symbol). In one such embodiment, symbol display areas relatively close to the designated symbol display area have a relatively higher probability of being included in the designated set of the symbol display areas than symbol display areas relatively far from the designated symbol display area. Put differently, in this embodiment, the gaming system is more likely to select a symbol display area that is relatively close to the designated symbol display area for inclusion in the designated set of the symbol display areas than a symbol display area that is relatively far from the designated symbol display area.

In another such embodiment, symbol display areas relatively close to the designated symbol display area have a relatively lower probability of being included in the designated set of the symbol display areas than symbol display areas relatively far from the designated symbol display area. Put differently, in this embodiment, the gaming system is more likely to select a symbol display area that is relatively far from the designated symbol display area for inclusion in the designated set of the symbol display areas than a symbol display area that is relatively close to the designated symbol display area.

In various embodiments, upon an occurrence of the triggering event, the gaming system determines which symbol display areas to include in the designated set of the symbol display areas based at least in part on one of a plurality of different patterns. In one such embodiment, upon an occurrence of the triggering event, the gaming system includes the symbol display areas included in a same row as the symbol display area displaying the designated symbol in the designated set of the symbol display areas. In another such embodiment, upon an occurrence of the triggering event, the gaming system includes the symbol display areas included in a same column as the symbol display area displaying the designated symbol in the designated set of the symbol display areas In another such embodiment, upon an occurrence of the triggering event, the gaming system includes the symbol display areas included in a same row and/or a same column as the symbol display area displaying the designated symbol in the designated set of the symbol display areas. In another such embodiment, upon an occurrence of the triggering event, the gaming system includes the symbol display areas adjacent to the symbol display area displaying the designated symbol in the designated set of the symbol display areas. In another such embodiment, upon an occurrence of the triggering event, the gaming system includes the symbol display areas diagonally adjacent to the symbol display area displaying the designated symbol in the designated set of the symbol display areas.

In certain embodiments, the slot game includes a plurality of different triggering symbols. In these embodiments, upon an occurrence of the triggering event, the gaming system determines which symbol display areas to include in the designated set of the symbol display areas based on which particular triggering symbol is displayed. For instance, if a first triggering symbol is displayed, the gaming system employs a first pattern to determine the designated set of the symbol display areas, but if a second triggering symbol is displayed, the gaming system employs a second different pattern to determine the designated set of the symbol display areas.

In certain embodiments, upon an occurrence of the triggering event, the gaming system enables the player to select at least one symbol display area to include in the designated set of the symbol display areas. In other embodiments, the gaming system determines which symbol display areas to include in the designated set of the symbol display areas based, at least in part, on the player's wager amount.

Figure 3A:
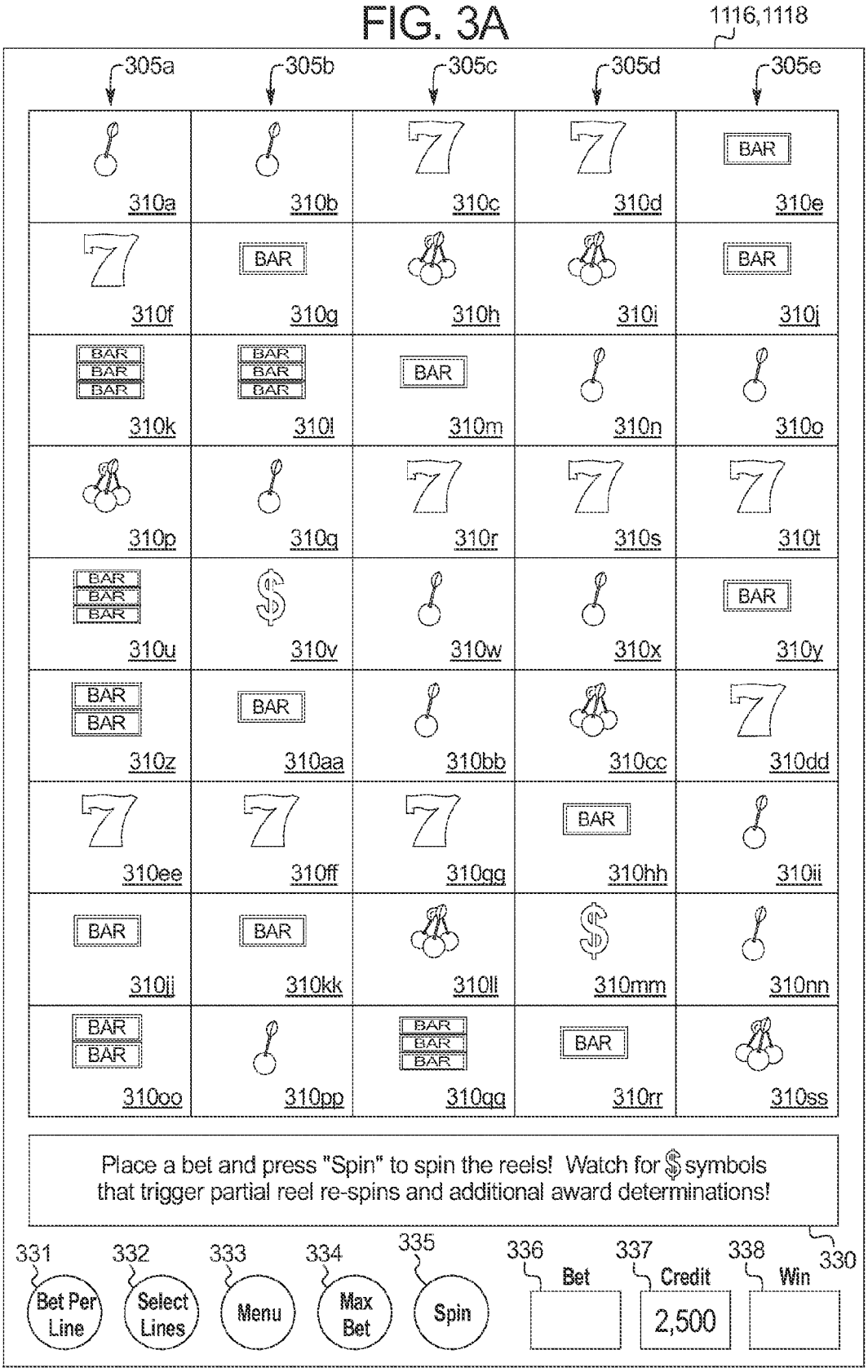
FIGS. 3A and 3B illustrate screen shots of another example embodiment of the gaming system of the present disclosure providing the slot game having the partial reel re-spin feature.
Figure 3B:
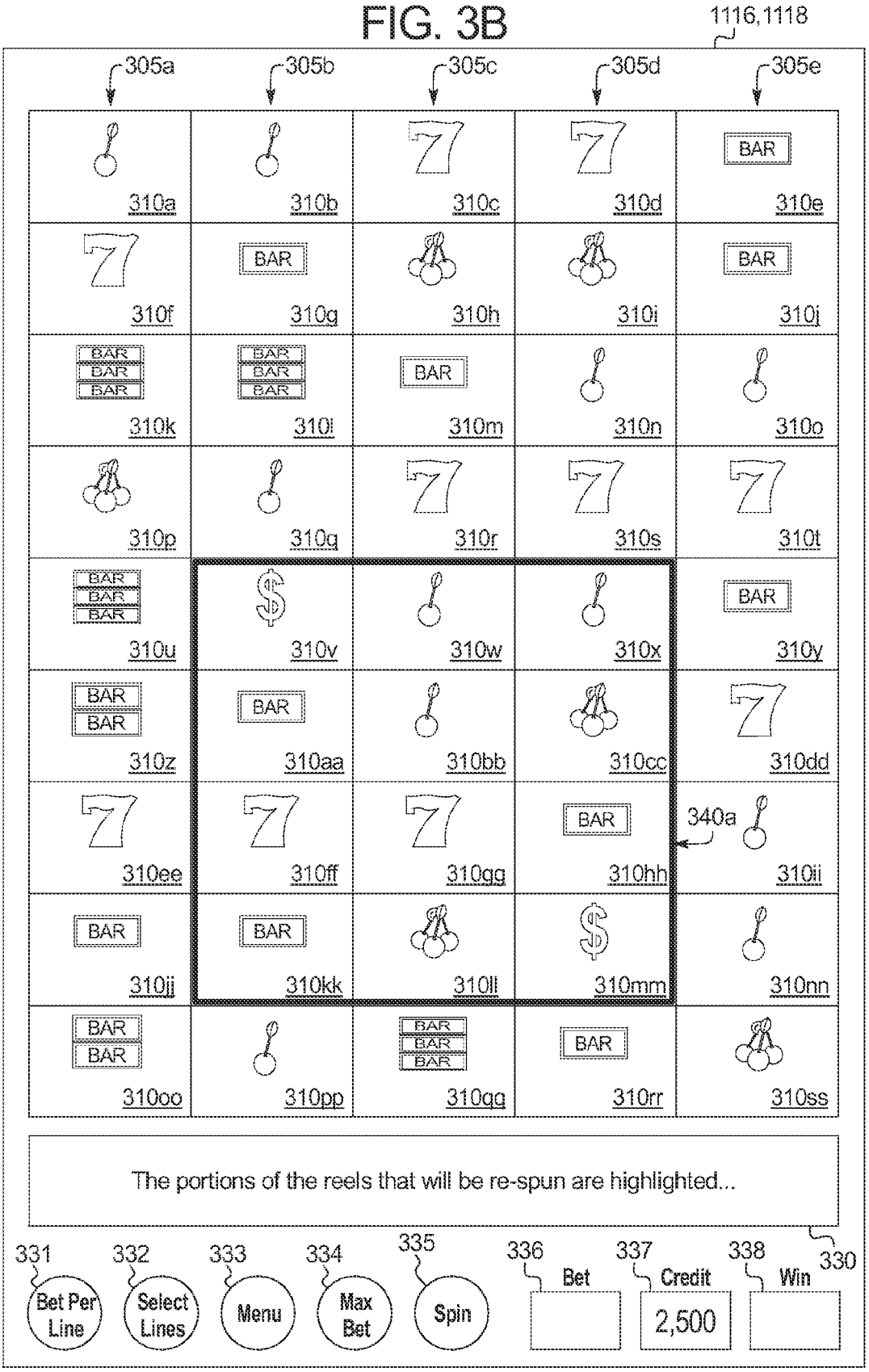

In certain embodiments, when two triggering symbols are displayed in different rows and different columns, the two triggering symbols define opposing corners of the designated set of the symbol display areas. FIGS. 3A and 3B illustrate screen shots of one such example embodiment of the gaming system of the present disclosure. Specifically, FIG. 3A illustrates a screen shot of the gaming system following a spin of the first set of reels. Here, the gaming system displays, in pertinent part, a Dollar Sign symbol 320*v* (i.e., a triggering symbol in this example embodiment) at the symbol display area 310*v* and a Dollar Sign symbol 320*mm* at the symbol display area 310*mm*. As shown in FIG. 3B, in this example embodiment, the gaming system determines a designated set of the symbol display area 340*a* including the symbol display areas 310*v* and 310*mm*, which define opposing corners of the designated set of the symbol display areas 340*a*.

In certain such embodiments, when the two triggering symbols are displayed at the symbol display areas that define the opposing corners of the entire set of the symbol display areas (such as the symbol display areas 310*a* and 310*ss* shown in FIGS. 3A and 3B), the gaming system prevents the designated set of the symbol display areas from including all of the symbol display areas. In these embodiments, the gaming system selects a subset of the symbol display areas (such as randomly or based on any other suitable factor) to include in the designated set of the symbol display areas.

The triggering event that causes the gaming system to provide the partial reel re-spin feature may be any suitable event, such as (but not limited to): (a) the display of a triggering symbol in one of the symbol display areas following a spin of the first or second set of reels; (b) the display of a designated symbol combination following a spin of the first or second set of reels; (c) the display of a winning symbol combination following a spin of the first or second set of reels; (d) the gaming system providing the player a designated award (such as a progressive award or a jackpot award); (e) a total quantity of plays of the slot game played by the player during a gaming session reaching a designated quantity of plays; (f) the gaming system receiving a deposit of value to fund the gaming system at least a designated quantity of times during a gaming session; (g) a total amount wagered by the player during a gaming session reaching a designated amount wagered; (h) a total amount of credits or currency won by the player during a gaming session reaching a designated amount won; (i) a total amount of credits or currency lost by the player during a gaming session reaching a designated amount lost; (j) a time of day reaching a designated time of day; (k) a length of a gaming session reaching a designated length of time; (l) a play of a bonus game having not been provided within a designated amount of time during a gaming session; (m) a play of a bonus game having not been provided within a designated quantity of plays of the slot game during a gaming session; (n) the player achieving a designated quantity of consecutive winning outcomes during a gaming session; (o) the player achieving a designated quantity of consecutive losing outcomes during a gaming session; (p) a total quantity of winning outcomes achieved by the player during a gaming session reaching a designated quantity; (q) a total quantity of losing outcomes achieved by the player during a gaming session reaching a designated quantity; (r) a total amount of coin-in during a gaming session reaching a designated quantity; (s) a credit balance of the player reaching a designated credit balance; (t) a total amount of currency deposited by the player during a gaming session reaching a designated amount; (u) a change in frequency of play reaching a designated amount; (v) a ticket, coupon, or promotion being inserted or otherwise entered (such as by typing in a promotion code or scanning a barcode); (w) a designated quantity of credits being transferred onto the gaming system; (x) player tracking points being converted into one or more credits; and/or (y) a triggering event occurring during play of a community or multiplayer game.

Figure 4A:
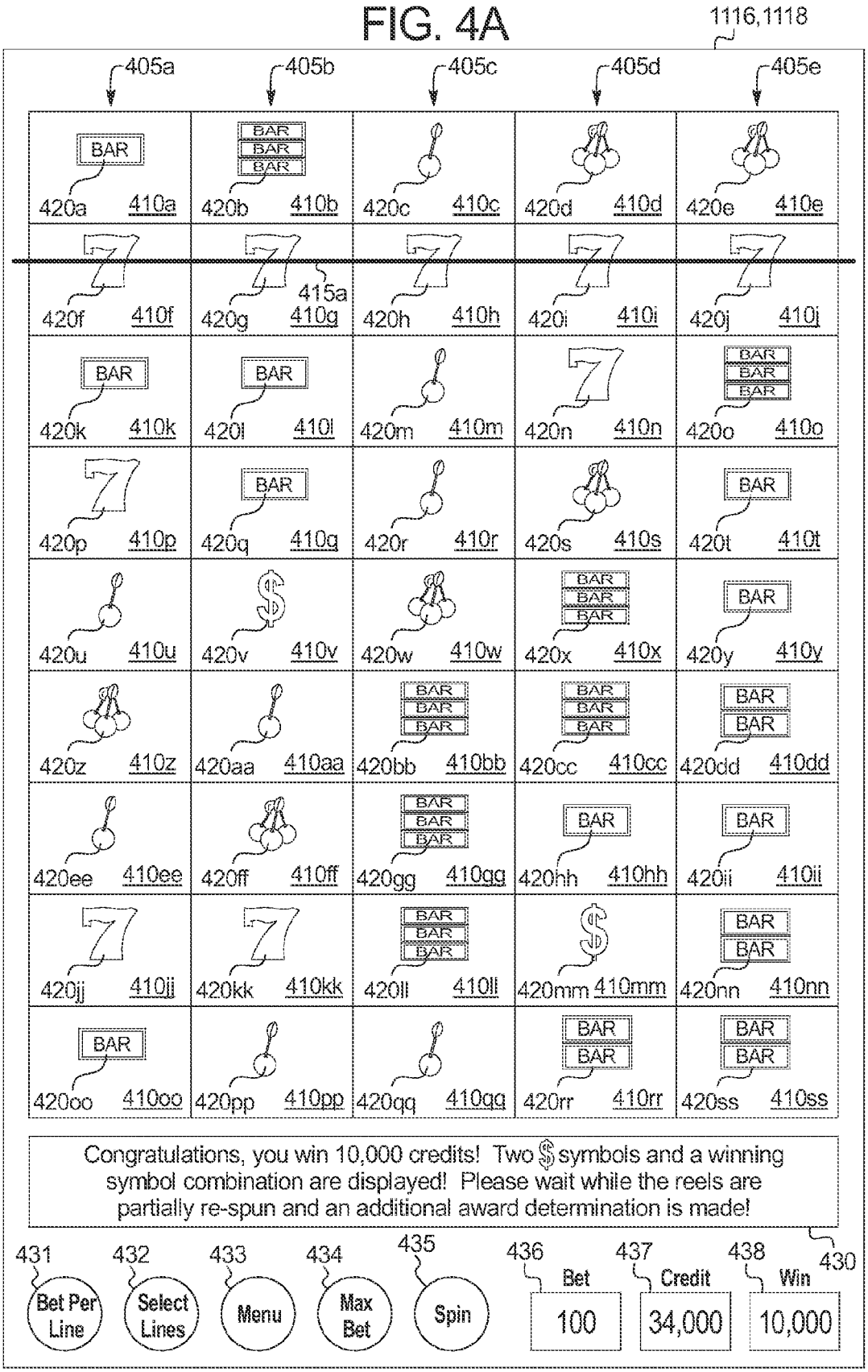
FIGS. 4A and 4B illustrate screen shots of another example embodiment of the gaming system of the present disclosure providing the slot game having the partial reel re-spin feature.
Figure 4B:
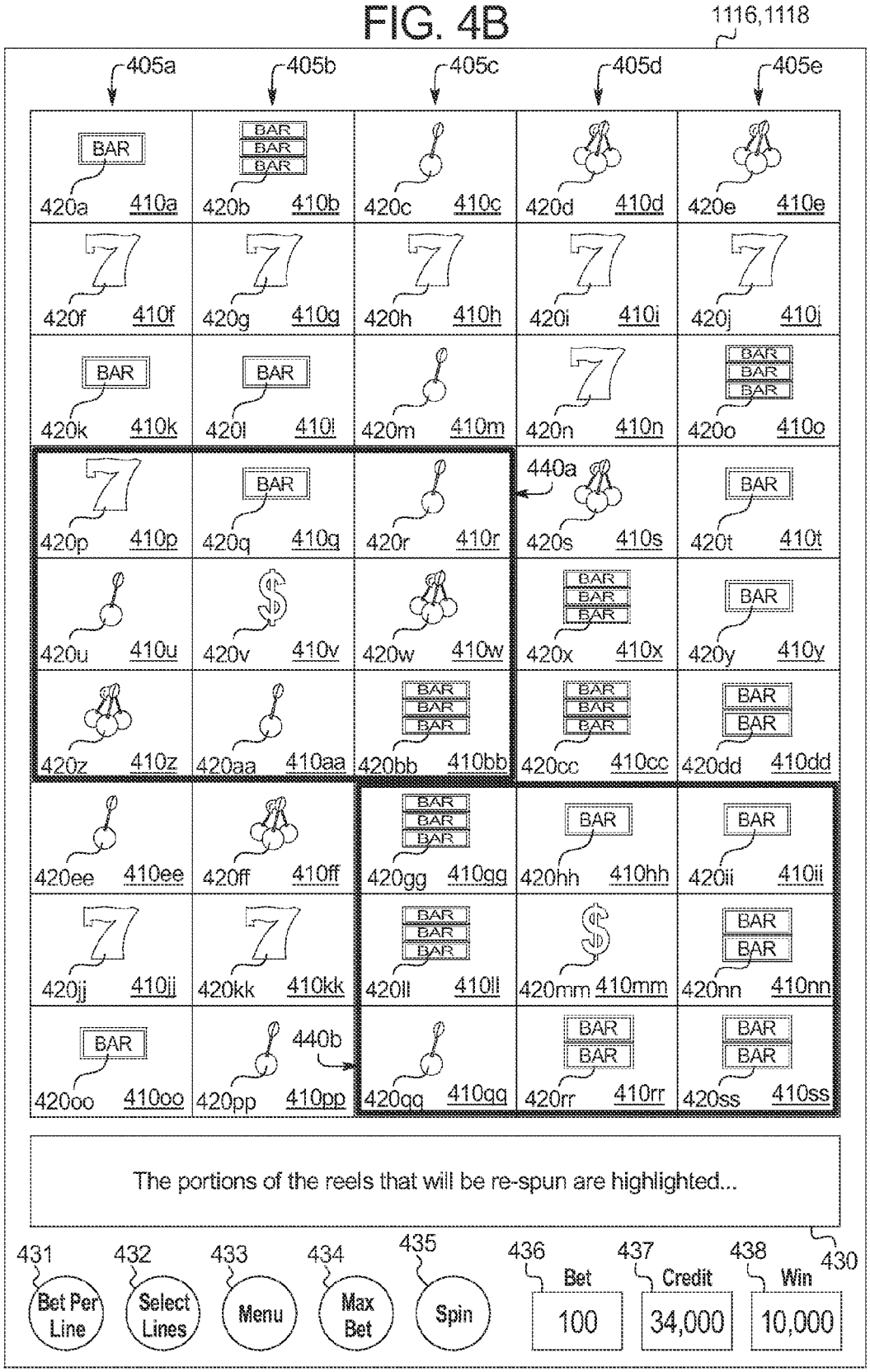

FIGS. 4A and 4B illustrate screen shots of another example embodiment of the gaming system of the present disclosure configured to provide the partial reel re-spin feature when: (a) a designated symbol combination is displayed, and (b) a triggering symbol is displayed. In other words, in this example embodiment, the triggering event occurs when both the designated symbol combination and the triggering symbol are displayed following a spin of the first set of reels, and does not occur when only one of or neither of the designated symbol combination and the triggering symbol is displayed following a spin of the first set of reels. In this example embodiment, the designated symbol combination is any winning symbol combination and the triggering symbol is the Dollar Sign symbol.

FIG. 4A illustrates a screen shot of the gaming system following a spin of the first set of reels. In this example embodiment, following the spin of the first set of reels, the gaming system displays: (a) Bar symbol 420*a* is displayed at the symbol display area 410*a*, (b) Triple Bar symbol 420*b* is displayed at the symbol display area 410*b*, (c) Cherry symbol 420*c* is displayed at the symbol display area 410*c*, (d) Triple Cherry symbol 420*d* is displayed at the symbol display area 410*d*, (e) Triple Cherry symbol 420*e* is displayed at the symbol display area 410*e*, (f) Seven symbol 420*f* is displayed at the symbol display area 410*f*, (g) Seven symbol 420*g* is displayed at the symbol display area 410*g*, (h) Seven symbol 420*h* is displayed at the symbol display area 410*h*, (i) Seven symbol 420*i* is displayed at the symbol display area 410*i*, (j) Seven symbol 420*j* is displayed at the symbol display area 410*j*, (k) Bar symbol 420*k* is displayed at the symbol display area 410*k*, (l) Bar symbol 420*l* is displayed at the symbol display area 410*l*, (m) Cherry symbol 420*m* is displayed at the symbol display area 410*m*, (n) Seven symbol 420*n* is displayed at the symbol display area 410*n*, (o) Triple Bar symbol 4200 is displayed at the symbol display area 4100, (p) Seven symbol 420*p* is displayed at the symbol display area 410*p*, (q) Bar symbol 420*q* is displayed at the symbol display area 410*q*, (r) Cherry symbol 420*r* is displayed at the symbol display area 410*r*, (s) Triple Cherry symbol 420*s* is displayed at the symbol display area 410*s*, (t) Bar symbol 420*t* is displayed at the symbol display area 410*t*, (u) Cherry symbol 420*u* is displayed at the symbol display area 410*u*, (v) Dollar Sign symbol 420*v* is displayed at the symbol display area 410*v*, (w) Triple Cherry symbol 420*w* is displayed at the symbol display area 410*w*, (x) Triple Bar symbol 420*x* is displayed at the symbol display area 410*x*, (y) Bar symbol 420*y* is displayed at the symbol display area 410*y*, (z) Triple Cherry symbol 420*z* is displayed at the symbol display area 410*z*, (aa) Cherry symbol 420*aa* is displayed at the symbol display area 410*aa*, (bb) Triple Bar symbol 420*bb* is displayed at the symbol display area 410*bb*, (cc) Triple Bar symbol 420*ee* is displayed at the symbol display area 410*cc*, (dd) Double Bar symbol 420*dd* is displayed at the symbol display area 410*dd*, (ee) Cherry symbol 420*ee* is displayed at the symbol display area 410*ee*, (ff) Triple Cherry symbol 420*ff* is displayed at the symbol display area 410*ff*, (gg) Triple Bar symbol 420*gg* is displayed at the symbol display area 410*gg*, (hh) Bar symbol 420*hh* is displayed at the symbol display area 410*hh*, (ii) Bar symbol 420*ii* is displayed at the symbol display area 410*ii*, (jj) Seven symbol 420*jj* is displayed at the symbol display area 410*jj*, (kk) Seven symbol 420*kk* is displayed at the symbol display area 410*kk*, (ll) Triple Bar symbol 420*ll* is displayed at the symbol display area 410*ll*, (mm) Dollar Sign symbol 420*mm* is displayed at the symbol display area 410*mm*, (nn) Double Bar symbol 420*nn* is displayed at the symbol display area 410*nn*, (oo) Bar symbol 42000*oo* is displayed at the symbol display area 410*oo*, (pp) Cherry symbol 420*pp* is displayed at the symbol display area 410*pp*, (qq) Cherry symbol 420*qq* is displayed at the symbol display area 410*qq*, (rr) Double Bar symbol 420*rr* is displayed at the symbol display area 410*rr*, and (ss) Double Bar symbol 420*ss* is displayed at the symbol display area 410*ss*.

The gaming system determines any awards associated with the symbols displayed at the symbol display areas by determining whether any winning combinations of the symbols included in the paytable associated with the slot game are displayed at the symbol display areas associated with any of the wagered-on paylines. In this example embodiment, the gaming system determines an award of 10,000 credits associated with the Seven-Seven-Seven-Seven-Seven winning symbol combination displayed at the symbol display areas associated with a payline 415*a*. The gaming system displays the award of 10,000 credits in the award meter 438 and updates the player's credit meter 437 to reflect the award of 10,000 credits.

The gaming system determines whether the triggering event occurred by, in this example embodiment, determining whether both: (a) any winning symbol combination (i.e., a designated symbol combination in this example embodiment), and (b) at least one Dollar Sign symbol (i.e., the triggering symbol in this example embodiment) are displayed at the symbol display areas. Here, the gaming system determines that: (a) the Seven-Seven-Seven-Seven-Seven winning symbol combination, and (b) the Dollar Sign symbol 420*v* is displayed at the symbol display area 410*v* and the Dollar Sign symbol 420*mm* is displayed at the symbol display area 410*mm*. The gaming system displays the following message in the message box 430: "CONGRATULATIONS, YOU WIN 10,000 CREDITS!. TWO $ SYMBOLS AND A WINNING SYMBOL COMBINATION ARE DISPLAYED! PLEASE WAIT WHILE THE REELS ARE PARTIALLY RE-SPUN AND AN ADDITIONAL AWARD DETERMINATION IS MADE!"

As shown in FIG. 4B, for each displayed triggering symbol, the gaming system determines a designated set of the symbol display areas. Specifically, for the Dollar Sign symbol 420*v*, the gaming system determines a designated set of the symbol display areas 440*a* including: (i) the symbol display area 410*v* (i.e., the symbol display area at which the Dollar Sign symbol 420*v* is displayed); (ii) the symbol display areas 410*q*, 410*u*, 410*w*, and 410*aa* (i.e., each symbol display area adjacent to the symbol display area 410*v* at which the Dollar Sign symbol 420*v* is displayed); and (iii) the symbol display areas 410*p*, 410*r*, 410*z*, and 410*bb* (i.e., each symbol display area diagonally adjacent to the symbol display area 410*v* at which the Dollar Sign symbol 420*v* is displayed). Similarly, for the Dollar Sign symbol 420*mm*, the gaming system determines a designated set of the symbol display areas 440*b* including: (i) the symbol display area 410*mm* (i.e., the symbol display area at which the Dollar Sign symbol 420*mm* is displayed); (ii) the symbol display areas 410*hh*, 410*ll*, 410*nn*, and 410*rr* (i.e., each symbol display area adjacent to the symbol display area 410*mm* at which the Dollar Sign symbol 420*mm* is displayed); and (iii) the symbol display areas 410*gg*, 410*ii*, 410*qq*, and 410*ss* (i.e., each symbol display area diagonally adjacent to the symbol display area 410*mm* at which the Dollar Sign symbol 420*mm* is displayed). The gaming system displays the following message in the message box 430: "THE PORTIONS OF THE REELS THAT WILL BE RE-SPUN ARE HIGHLIGHTED . . . "

In various embodiments, when a designated symbol combination is displayed following a spin of the first set of the reels, the gaming system: (a) designates one of the symbols of the first set of symbols as a triggering symbol, and (b) determines whether the triggering symbol is displayed at any of the symbol display areas other than the symbol display areas displaying the designated symbol combination. If the triggering symbol is displayed at a symbol display area other than the symbol display areas displaying the designated symbol combination, the gaming system provides the partial reel re-spin feature. In one such embodiment, the gaming system determines which of the symbols of the first set of symbols to designate as the triggering symbol based at least in part on the displayed designated symbol combination. For instance, in one example embodiment in which the designated symbol combination is any winning symbol combination and a winning symbol combination is displayed following a spin of the first set of reels, the gaming system designates the symbol of that winning symbol combination as the triggering symbol.

Figure 5A:
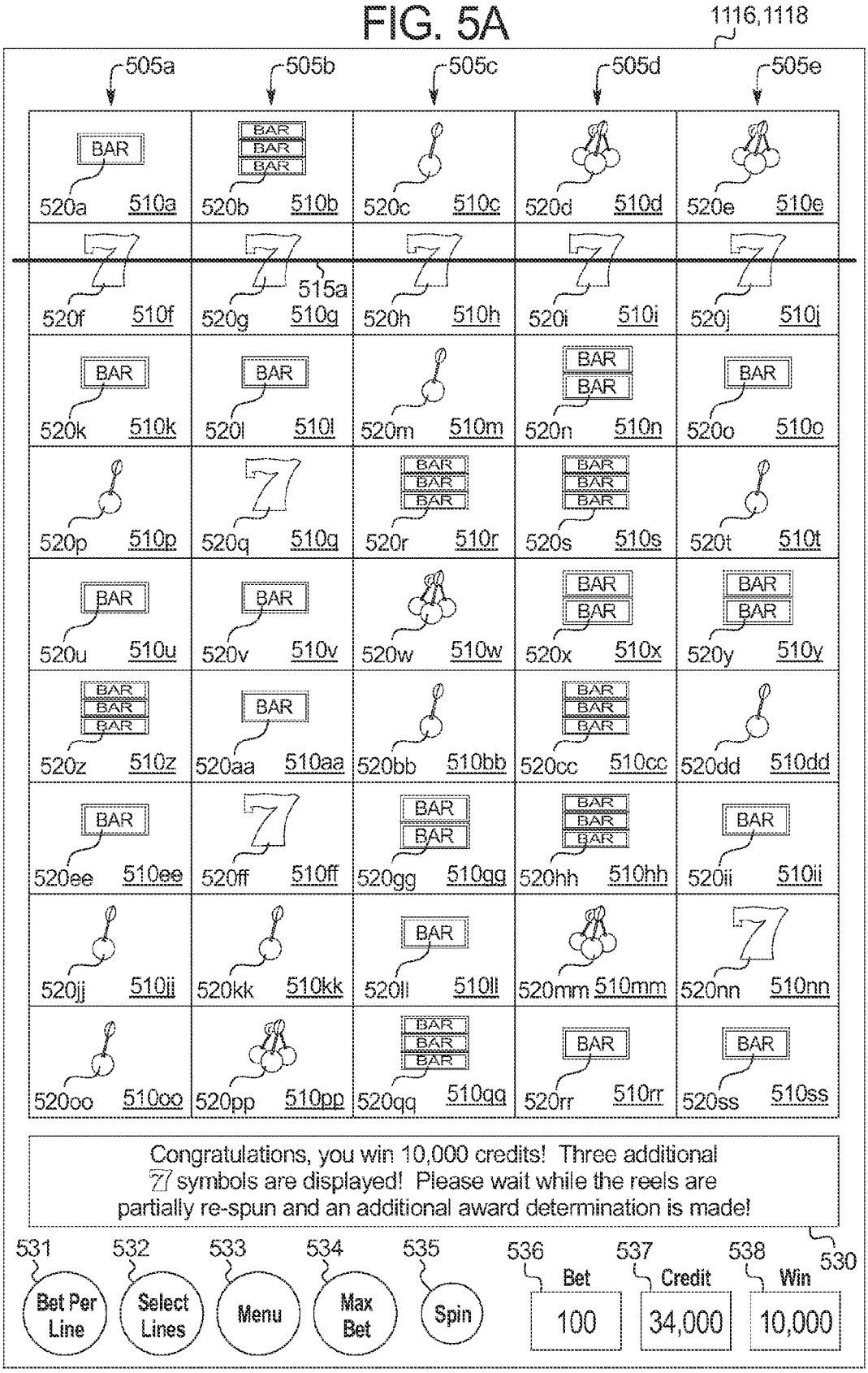
FIGS. 5A and 5B illustrate screen shots of another example embodiment of the gaming system of the present disclosure providing the slot game having the partial reel re-spin feature.
Figure 5B:
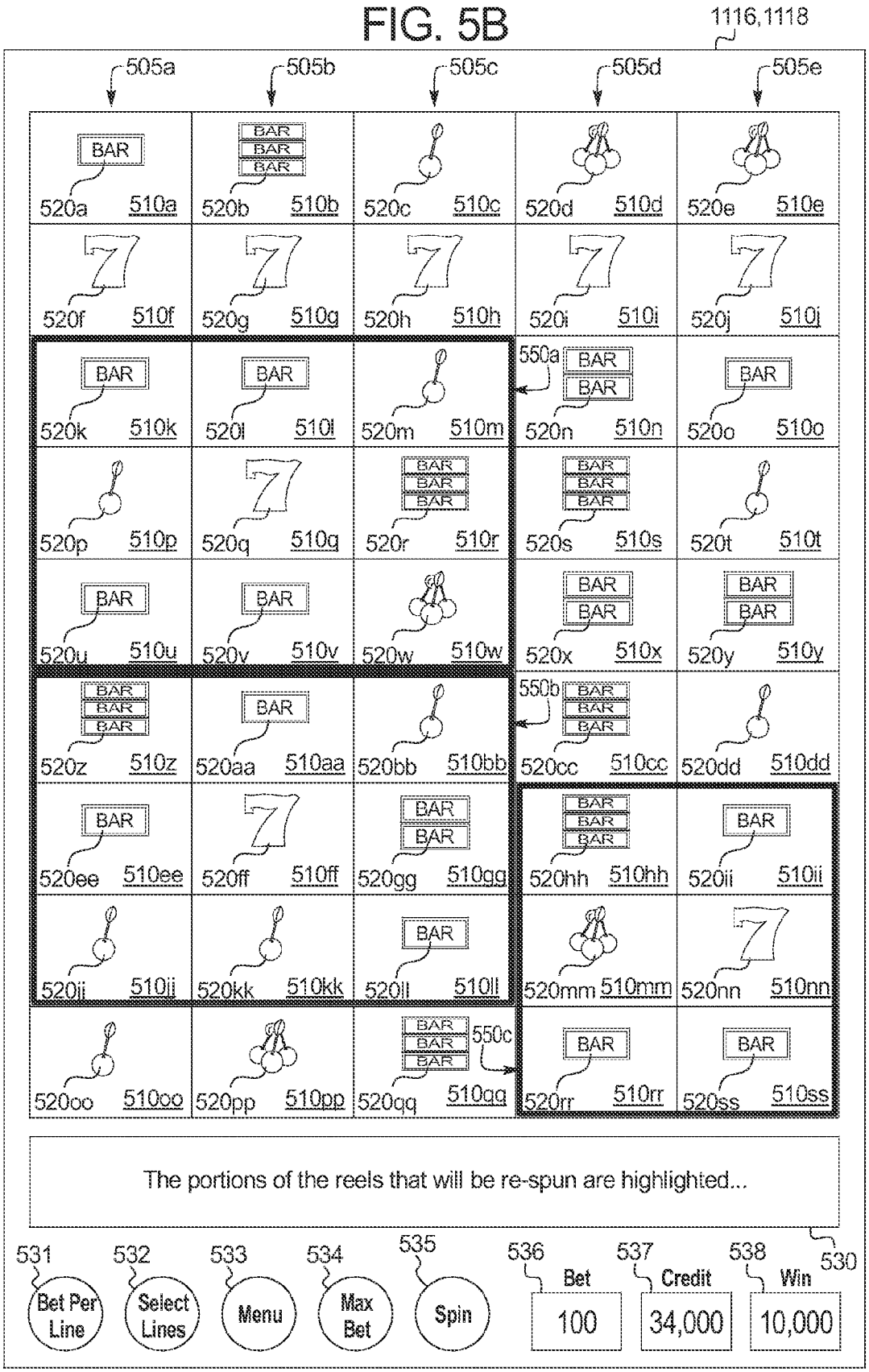

FIGS. 5A and 5B illustrate screen shots of one such example embodiment of the gaming system of the present disclosure configured to provide the partial reel re-spin feature when: (a) a designated symbol combination is displayed, and (b) a triggering symbol is displayed at a symbol display area other than the symbol display areas displaying the designated symbol combination. In other words, in this example embodiment, the triggering event occurs when the designated symbol combination and the triggering symbol are displayed at distinct symbol display areas following a spin of the first set of reels. In this example embodiment, the designated symbol combination is any winning symbol combination, and the gaming system determines which of the symbols of the first set of symbols to designate as the triggering symbol based at least in part on the displayed designated symbol combination.

FIG. 5A illustrates a screen shot of the gaming system following a spin of the first set of reels. In this example embodiment, following the spin of the first set of reels, the gaming system displays: (a) Bar symbol 520*a* is displayed at the symbol display area 510*a*, (b) Triple Bar symbol 520*b* is displayed at the symbol display area 510*b*, (c) Cherry symbol 520*c* is displayed at the symbol display area 510*c*, (d) Triple Cherry symbol 520*d* is displayed at the symbol display area 510*d*, (e) Triple Cherry symbol 520*e* is displayed at the symbol display area 510*e*, (f) Seven symbol 520*f* is displayed at the symbol display area 510*f*, (g) Seven symbol 520*g* is displayed at the symbol display area 510*g*, (h) Seven symbol 520*h* is displayed at the symbol display area 510*h*, (i) Seven symbol 520*i* is displayed at the symbol display area 510*i*, (j) Seven symbol 520*j* is displayed at the symbol display area 510*j*, (k) Bar symbol 520*k* is displayed at the symbol display area 510*k*, (l) Bar symbol 520*l* is displayed at the symbol display area 510*l*, (m) Cherry symbol 520*m* is displayed at the symbol display area 510*m*, (n) Double Bar symbol 520*n* is displayed at the symbol display area 510*n*, (o) Bar symbol 520*o* is displayed at the symbol display area 5100, (p) Cherry symbol 520*p* is displayed at the symbol display area 510*p*, (q) Seven symbol 520*q* is displayed at the symbol display area 510*q*, (r) Triple Bar symbol 520*r* is displayed at the symbol display area 510*r*, (s) Triple Bar symbol 520*s* is displayed at the symbol display area 510*s*, (t) Cherry symbol 520*t* is displayed at the symbol display area 510*t*, (u) Bar symbol 520*u* is displayed at the symbol display area 510*u*, (v) Bar symbol 520*v* is displayed at the symbol display area 510*v*, (w) Triple Cherry symbol 520*w* is displayed at the symbol display area 510*w*, (x) Double Bar symbol 520*x* is displayed at the symbol display area 510*x*, (y) Double Bar symbol 520*y* is displayed at the symbol display area 510*y*, (z) Triple Bar symbol 520*z* is displayed at the symbol display area 510*z*, (aa) Bar symbol 520*aa* is displayed at the symbol display area 510*aa*, (bb) Cherry symbol 520*bb* is displayed at the symbol display area 510*bb*, (cc) Triple Bar symbol 520*cc* is displayed at the symbol display area 510*cc*, (dd) Cherry symbol 520*dd* is displayed at the symbol display area 510*dd*, (ee) Bar symbol 520*ee* is displayed at the symbol display area 510*ee*, (ff) Seven symbol 520*ff* is displayed at the symbol display area 510*ff*, (gg) Double Bar symbol 520*gg* is displayed at the symbol display area 510*gg*, (hh) Triple Bar symbol 520*hh* is displayed at the symbol display area 510*hh*, (ii) Bar symbol 520*ii* is displayed at the symbol display area 510*ii*, (jj) Cherry symbol 520*jj* is displayed at the symbol display area 510*jj*, (kk) Cherry symbol 520*kk* is displayed at the symbol display area 510*kk*, (ll) Bar symbol 52011 is displayed at the symbol display area 510*ll*, (mm) Triple Cherry symbol 520*mm* is displayed at the symbol display area 510*mm*, (nn)

Seven symbol 520*nn* is displayed at the symbol display area 510*nn*, (oo) Cherry symbol 520*oo* is displayed at the symbol display area 510*oo*, (pp) Triple Cherry symbol 520*pp* is displayed at the symbol display area 510*pp*, (qq) Triple Bar symbol 520*qq* is displayed at the symbol display area 510*qq*, (rr) Bar symbol 520*rr* is displayed at the symbol display area 510*rr*, and (ss) Bar symbol 520*ss* is displayed at the symbol display area 510*ss*.

The gaming system determines any awards associated with the symbols displayed at the symbol display areas by determining whether any winning combinations of the symbols included in the paytable associated with the slot game are displayed at the symbol display areas associated with any of the wagered-on paylines. In this example embodiment, the gaming system determines an award of 10,000 credits associated with the Seven-Seven-Seven-Seven-Seven winning symbol combination displayed at the symbol display areas associated with a payline 515*a*. The gaming system displays the award of 10,000 credits in the award meter 538 and updates the player's credit meter 537 to reflect the award of 10,000 credits.

The gaming system designates the Seven symbol, which is the symbol included in the displayed winning symbol combination, as the triggering symbol. The gaming system determines whether the triggering event occurred by, in this example embodiment, determining whether the Seven symbol (i.e., the triggering symbol in this example embodiment) is displayed at a symbol display area other than the symbol display areas displaying the winning symbol combination. Here, the gaming system determines that the Seven symbol 520*q* is displayed at the symbol display area 510*q* (which is not one of the symbol display areas at which one of the Seven symbols of the winning symbol combination is displayed), the Seven symbol 520*ff* is displayed at the symbol display area 510*ff* (which is not one of the symbol display areas at which one of the Seven symbols of the winning symbol combination is displayed), and the Seven symbol 520*nn* is displayed at the symbol display area 510*nn* (which is not one of the symbol display areas at which one of the Seven symbols of the winning symbol combination is displayed). The gaming system displays the following message in the message box 530: "CONGRATULATIONS, YOU WIN 10,000 CREDITS!. THREE ADDITIONAL 7 SYMBOLS ARE DISPLAYED. PLEASE WAIT WHILE THE REELS ARE PARTIALLY RE-SPUN AND AN ADDITIONAL AWARD DETERMINATION IS MADE!"

As shown in FIG. 5B, for each displayed triggering symbol, the gaming system determines a designated set of the symbol display areas. Specifically, for the Seven symbol 520*q*, the gaming system determines a designated set of the symbol display areas 540*a* including: (i) the symbol display area 510*q* (i.e., the symbol display area at which the Seven symbol 520*q* is displayed); (ii) the symbol display areas 510*l*, 510*p*, 510*r*, and 510*v* (i.e., each symbol display area adjacent to the symbol display area 510*q* at which the Seven symbol 520*q* is displayed); and (iii) the symbol display areas 510*k*, 510*m*, 510*u*, and 510*w* (i.e., each symbol display area diagonally adjacent to the symbol display area 510*q* at which the Seven symbol 520*q* is displayed). Similarly, for the Seven symbol 520*ff*, the gaming system determines a designated set of the symbol display areas 540*b* including: (i) the symbol display area 510*ff* (i.e., the symbol display area at which the Seven symbol 520*ff* is displayed); (ii) the symbol display areas 510*aa*, 510*ee*, 510*gg*, and 510*kk* (i.e., each symbol display area adjacent to the symbol display area 510*ff* at which the Seven symbol 520*ff* is displayed); and (iii) the symbol display areas 510*z*, 510*bb*, 510*jj*, and 510*ll* (i.e., each symbol display area diagonally adjacent to the symbol display area 510*ff* at which the Seven symbol 520*ff* is displayed). Similarly, for the Seven symbol 520*nn*, the gaming system determines a designated set of the symbol display areas 540*c* including: (i) the symbol display area 510*nn* (i.e., the symbol display area at which the Seven symbol 520*nn* is displayed); (ii) the symbol display areas 510*ii*, 510*mm*, and 510*ss* (i.e., each symbol display area adjacent to the symbol display area 510*nn* at which the Seven symbol 520*nn* is displayed); and (iii) the symbol display areas 510*hh* and 510*rr* (i.e., each symbol display area diagonally adjacent to the symbol display area 510*nn* at which the Seven symbol 520*nn* is displayed). The gaming system displays the following message in the message box 530: "THE PORTIONS OF THE REELS THAT WILL BE RE-SPUN ARE HIGHLIGHTED . . . "

In certain embodiments, the gaming system merges designated sets of the symbol display areas that overlap one another into a single merged designated set of the symbol display areas. In other words, when two or more designated sets of the symbol display areas share a same one of the symbol display areas, the gaming system merges those designated sets of the symbol display areas to create a single, merged designated set of the symbol display areas.

Figure 6A:
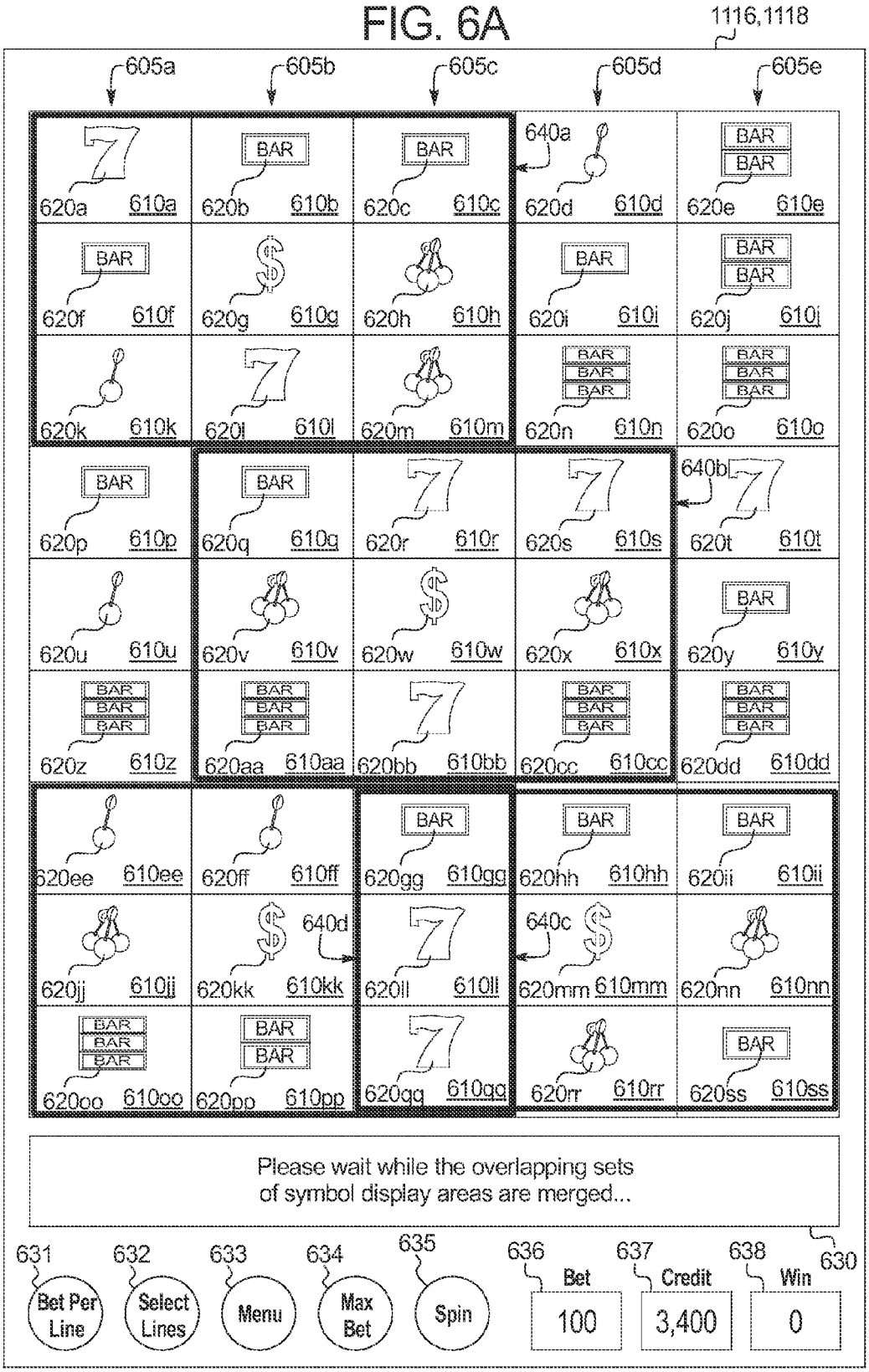
FIGS. 6A and 6B illustrate screen shots of another example embodiment of the gaming system of the present disclosure providing the slot game having the partial reel re-spin feature.
Figure 6B:
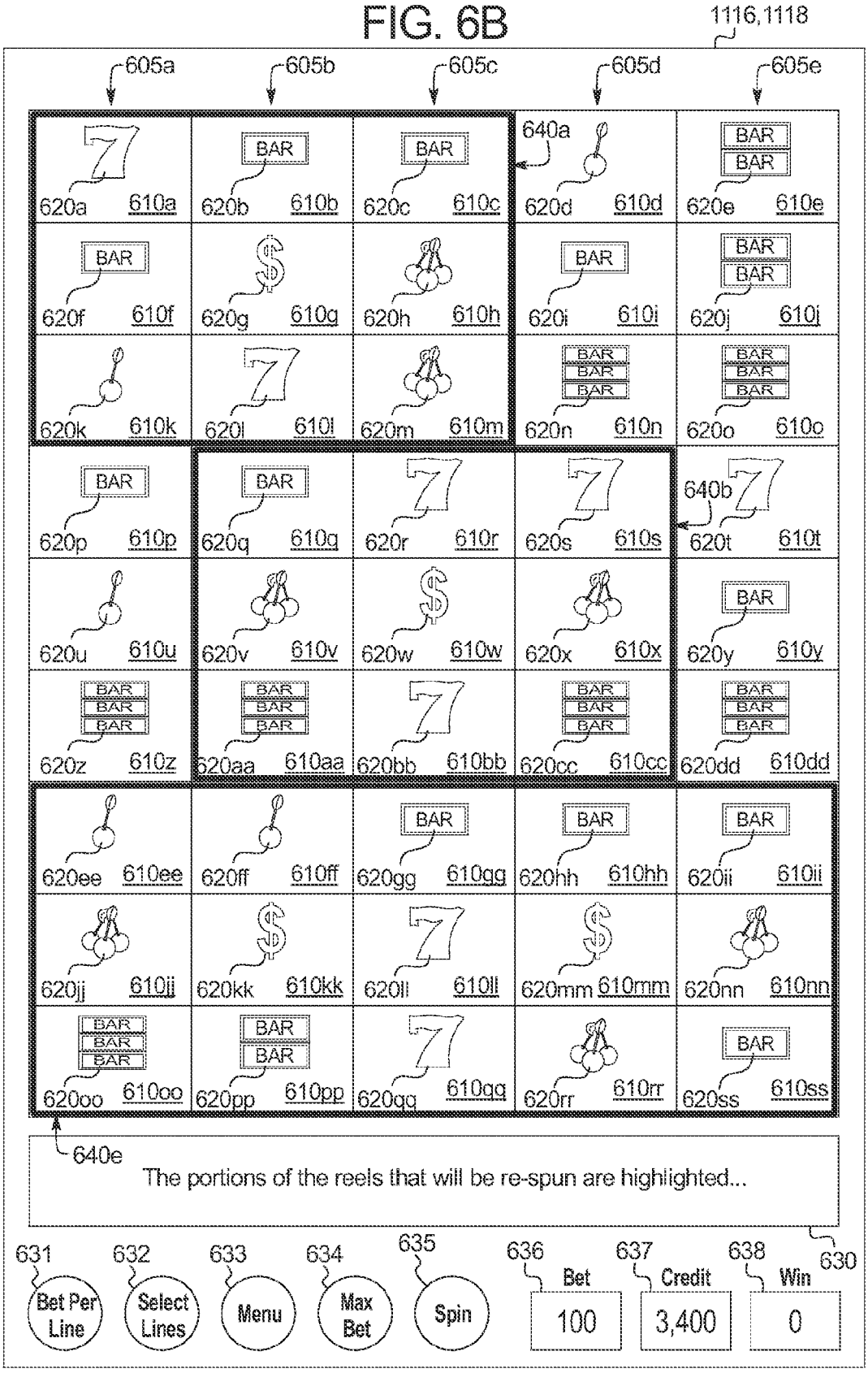

FIGS. 6A and 6B illustrate screen shots of one such example embodiment of the gaming system of the present disclosure configured to merge designated sets of the symbol display areas that each include at least one same one of the symbol display areas.

FIG. 6A illustrates a screen shot of the gaming system following a spin of the first set of reels. In this example embodiment, the gaming system has determined: (a) a designated set of the symbol display areas 640*a* associated with the displayed triggering symbol 620*g* and including the symbol display areas 610*a*, 610*b*, 610*c*, 610*f*, 610*g*, 610*h*, 610*k*, 610*l*, and 610*m*; (b) a designated set of the symbol display areas 640*b* associated with the displayed triggering symbol 620*w* and including the symbol display areas 610*q*, 610*r*, 610*s*, 610*v*, 610*w*, 610*x*, 610*aa*, 610*bb*, and 610*cc*; (c) a designated set of the symbol display areas 640*c* associated with the displayed triggering symbol 620*kk* and including the symbol display areas 610*ee*, 610*ff*, 610*gg*, 610*jj*, 610*kk*, 610*ll*, 610*oo*, 610*pp*, and 610*qq*; and (d) a designated set of the symbol display areas 640*d* associated with the displayed triggering symbol 620*mm* and including the symbol display areas 610*gg*, 610*hh*, 610*ii*, 610*ll*, 610*mm*, 610*nn*, 610*qq*, 610*rr*, and 610*ss*.

The gaming system determines whether any of the designated sets of the symbol display areas include at least one same one of the symbol display areas. Here, the gaming system determines that the designated set of the symbol display areas 640*c* and the designated set of the symbol display areas 640*d* each include the symbol display areas 610*gg*, 610*ll*, and 610*qq*. Accordingly, the gaming system determines to merge the designated sets of the symbol display areas 640*c* and 640*d*, and displays the following message in the message box 630: "PLEASE WAIT WHILE THE OVERLAPPING SETS OF SYMBOL DISPLAY AREAS ARE MERGED . . . "

As shown in FIG. 6B, the gaming system merges the designated sets of the symbol display areas 640*c* and 640*d* into a single merged set of the symbol display areas 640*e* including the symbol display areas 610*ee*, 610*ff*, 610*gg*, 610*h*, 610*ii*, 610*jj*, 610*kk*, 610*ll*, 610*mm*, 610*nn*, 61000*oo*, 610*pp*, 610*qq*, 610*rr*, and 610*ss*. The gaming system displays the following message in the message box 630: "THE PORTIONS OF THE REELS THAT WILL BE RE-SPUN ARE HIGHLIGHTED . . . "

Figure 7A:
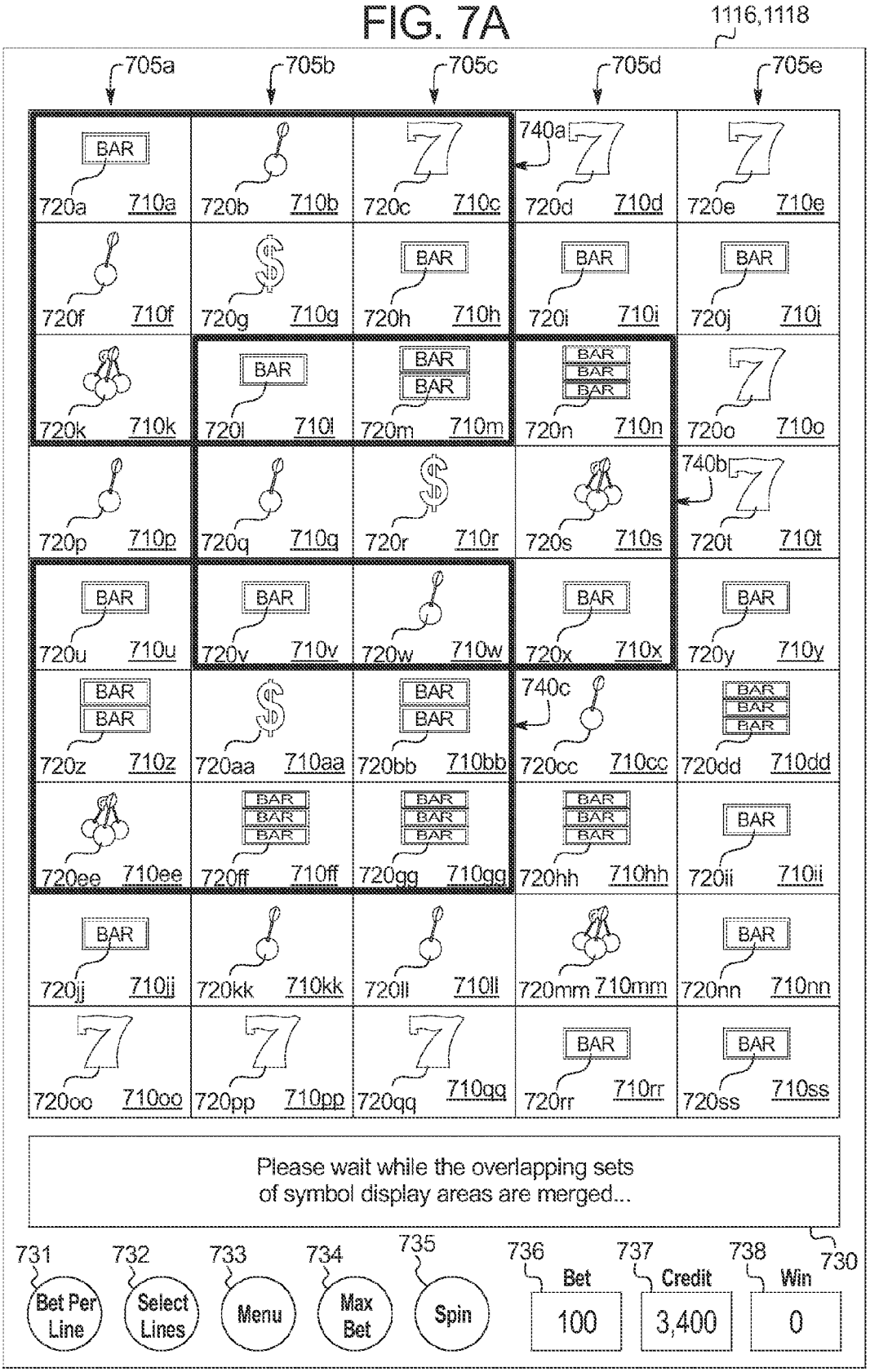
FIGS. 7A and 7B illustrate screen shots of another example embodiment of the gaming system of the present disclosure providing the slot game having the partial reel re-spin feature.
Figure 7B:
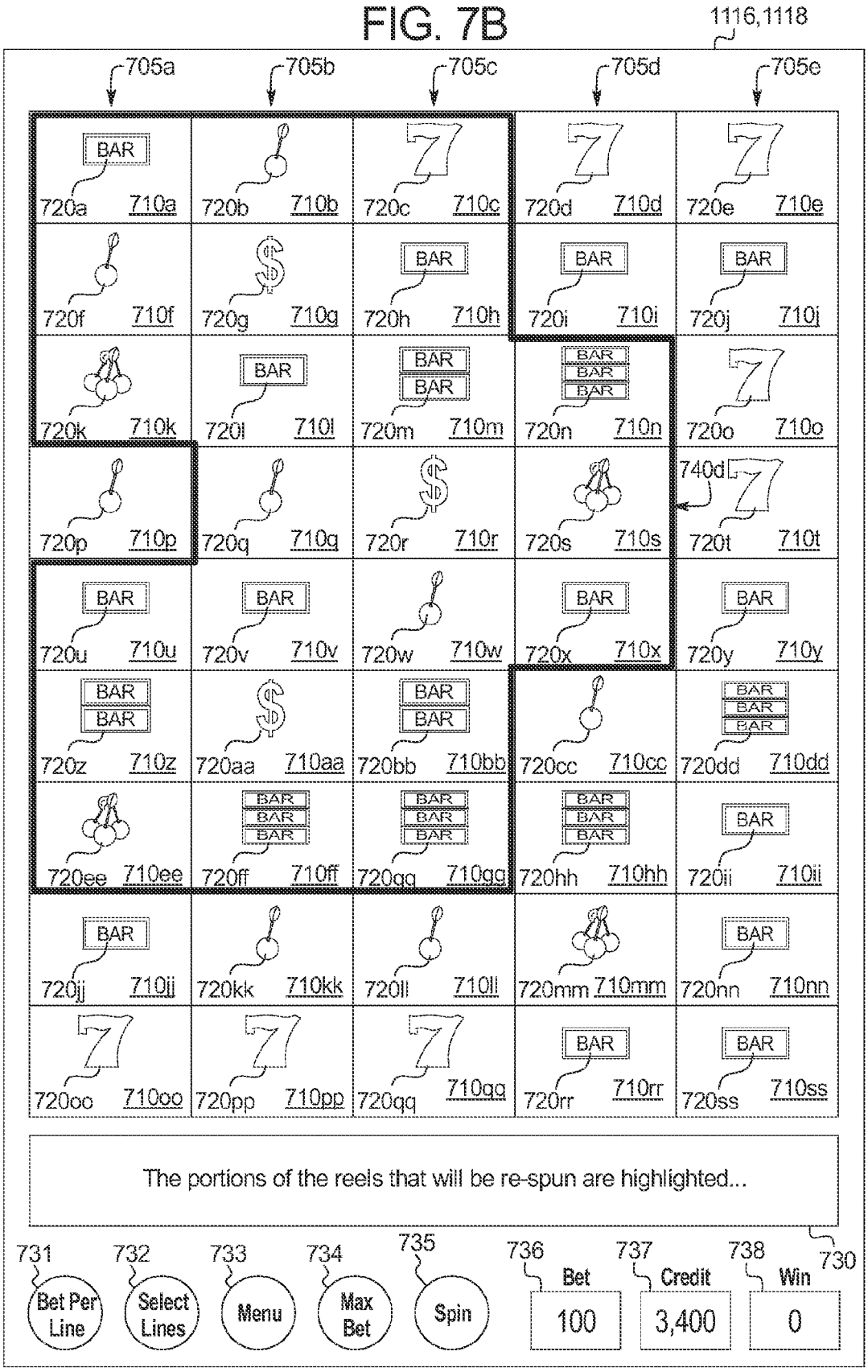

FIGS. 7A and 7B illustrate screen shots of another such example embodiment of the gaming system of the present disclosure configured to merge designated sets of the symbol display areas that each include at least one same one of the symbol display areas.

FIG. 7A illustrates a screen shot of the gaming system following a spin of the first set of reels. In this example embodiment, the gaming system has determined: (a) a designated set of the symbol display areas 740*a* associated with the displayed triggering symbol 720*g* and including the symbol display areas 710*a*, 710*b*, 710*c*, 710*f*, 710*g*, 710*h*, 710*k*, 710*l*, and 710*m*; (b) a designated set of the symbol display areas 740*b* associated with the displayed triggering symbol 720*r* and including the symbol display areas 710*l*, 710*m*, 710*n*, 710*q*, 710*r*, 710*s*, 710*v*, 710*w*, and 710*x*; and (c) a designated set of the symbol display areas 740*c* associated with the displayed triggering symbol 720*aa* and including the symbol display areas 710*u*, 710*v*, 710*w*, 710*z*, 710*aa*, 710*bb*, 710*ee*, 710*ff*, and 710*gg*.

The gaming system determines whether any of the designated sets of the symbol display areas include at least one same one of the symbol display areas. Here, the gaming system determines that: (a) the designated set of the symbol display areas 740*a* and the designated set of the symbol display areas 740*b* each include the symbol display areas 710*l* and 710*m*, and (b) the designated set of the symbol display areas 740*b* and 740*c* each include the symbol display areas 710*v* and 710*w*. Accordingly, the gaming system determines to merge the designated set of the symbol display areas 740*b* with both the designated set of the symbol display areas 740*a* and the designated set of the symbol display areas 740*c*, and displays the following message in the message box 730: "PLEASE WAIT WHILE THE OVERLAPPING SETS OF SYMBOL DISPLAY AREAS ARE MERGED . . . "

As shown in FIG. 7B, the gaming system merges the designated sets of the symbol display areas 740*a*, 740*b*, and 740*c* into a single merged set of the symbol display areas 740*d* including the symbol display areas 710*a*, 710*b*, 710*c*, 710*f*, 710*g*, 710*h*, 710*k*, 710*l*, 710*m*, 710*n*, 710*q*, 710*r*, 710*s*, 710*u*, 710*v*, 710*w*, 710*x*, 710*z*, 710*aa*, 710*bb*, 710*ee*, 710*ff*, and 710*gg*. The gaming system displays the following message in the message box 730: "THE PORTIONS OF THE REELS THAT WILL BE RE-SPUN ARE HIGHLIGHTED . . . "

In certain embodiments, the gaming system merges designated sets of the symbol display areas that share a common border into a single merged designated set of the symbol display areas. In other words, when at least one symbol display area of a first designated set of the symbol display areas is adjacent to (or, in other embodiments, adjacent symbol display areas or diagonally adjacent symbol display areas) at least one symbol display area of a second designated set of the symbol display areas, the gaming system merges those designated sets of the symbol display areas to create a single, merged designated set of the symbol display areas.

Figure 8A:
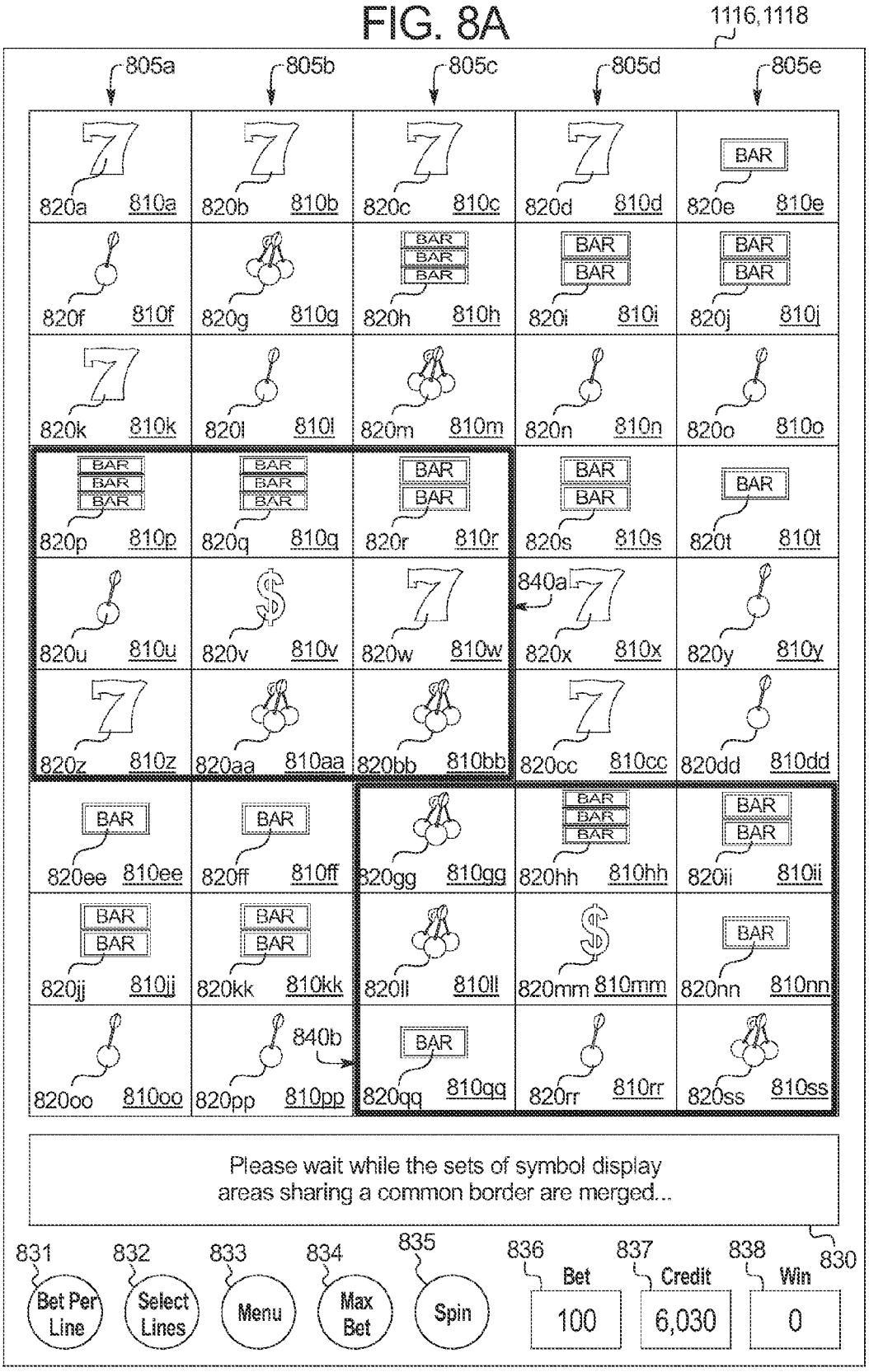
FIGS. 8A and 8B illustrate screen shots of another example embodiment of the gaming system of the present disclosure providing the slot game having the partial reel re-spin feature.
Figure 8B:
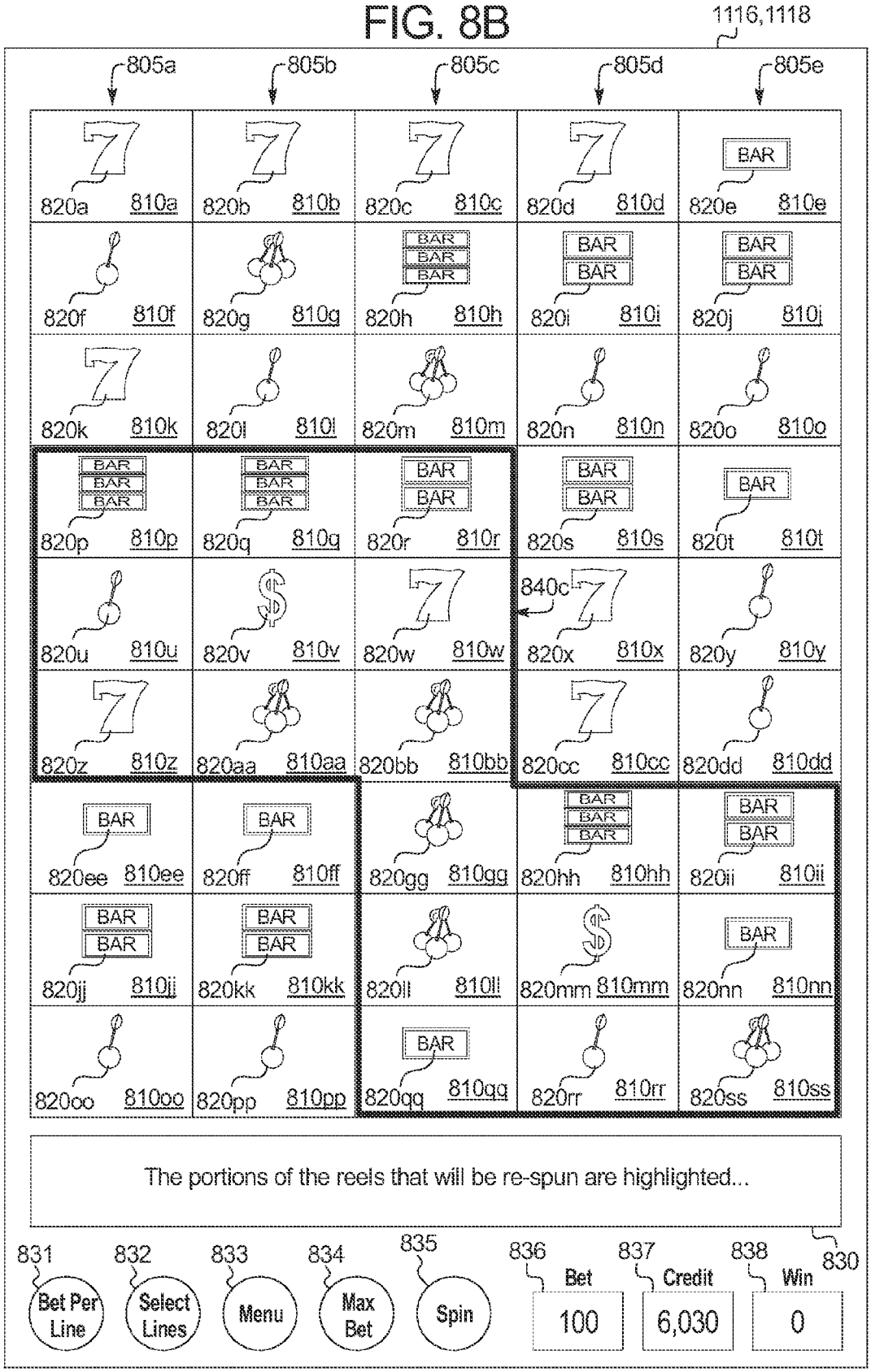

FIGS. 8A and 8B illustrate screen shots of another such example embodiment of the gaming system of the present disclosure configured to merge designated sets of the symbol display areas that share a common border into a single merged designated set of the symbol display areas.

FIG. 8A illustrates a screen shot of the gaming system following a spin of the first set of reels. In this example embodiment, the gaming system has determined: (a) a designated set of the symbol display areas 840*a* associated with the displayed triggering symbol 820*v* and including the symbol display areas 810*p*, 810*q*, 810*r*, 810*u*, 810*v*, 810*w*, 810*z*, 810*aa*, and 810*bb*; and (b) a designated set of the symbol display areas 840*b* associated with the displayed triggering symbol 820*mm* and including the symbol display areas 810*gg*, 810*hh*, 810*ii*, 810*ll*, 810*mm*, 810*nn*, 810*qq*, 810*rr*, and 810*ss*.

The gaming system determines whether at least one symbol display area of the designated set of the symbol display areas 840*a* is adjacent to at least one symbol display area of the designated set of the symbol display areas 840*b*. Here, the gaming system determines that the symbol display area 810*bb* of the designated set of the symbol display areas 840*a* is adjacent to the symbol display area 810*gg* of the designated set of the symbol display areas 840*b*. Accordingly, the gaming system determines to merge the designated set of the symbol display areas 840*a* and 840*b*, and displays the following message in the message box 830: "PLEASE WAIT WHILE THE SETS OF SYMBOL DISPLAY AREAS SHARING A COMMON BORDER ARE MERGED . . . "

As shown in FIG. 8B, the gaming system merges the designated sets of the symbol display areas 840*a* and 840*b* into a single merged set of the symbol display areas 840*c* including the symbol display areas 810*p*, 810*q*, 810*r*, 810*u*, 810*v*, 810*w*, 810*z*, 810*aa*, 810*bb*, 810*gg*, 810*hh*, 810*ii*, 810*ll*, 810*mm*, 810*nn*, 810*qq*, 810*rr*, and 810*ss*. The gaming system displays the following message in the message box 830: "THE PORTIONS OF THE REELS THAT WILL BE RE-SPUN ARE HIGHLIGHTED . . . "

In certain embodiments, when the gaming system determines a designated set of the symbol display areas upon the occurrence of the triggering event, the gaming system determines whether to display a designated symbol, such as a Wild symbol, at one or more of the symbol display areas of that designated set of the symbol display areas. For instance, in one example embodiment, after determining a designated set of the symbol display areas following the occurrence of the triggering event, the gaming system randomly determines (such as via a paytable-driven random determination), for each symbol display area in the designated set of the symbol display areas, whether to replace the symbol of the first set of symbols displayed at that symbol display area with a Wild symbol. Thereafter, for each symbol display area of the designated set of the symbol display areas at which a Wild symbol is not displayed, the gaming system replaces the symbol of the first set of symbols displayed at that symbol display area with a symbol of the second set of symbols.

In other embodiments, when the gaming system determines a designated set of the symbol display areas upon the occurrence of the triggering event, the gaming system determines whether to display a designated symbol, such as a Wild symbol, at one or more of the symbol display areas, including the symbol display areas not included in the designated set of the symbol display areas. For instance, in one example embodiment, after determining a designated set of the symbol display areas following the occurrence of the triggering event, the gaming system randomly determines (such as via a paytable-driven random determination), for each symbol display area (including those not included in the designated set of the symbol display areas), whether to replace the symbol of the first set of symbols displayed at that symbol display area with a Wild symbol. Thereafter, for each symbol display area of the designated set of the symbol display areas at which a Wild symbol is not displayed, the gaming system replaces the symbol of the first set of symbols displayed at that symbol display area with a symbol of the second set of symbols.

In various embodiments, the second set of one or more symbols only includes Wild symbols. Thus, in these embodiments, when the gaming system determines a designated set of the symbol display areas upon the occurrence of the triggering event, for each symbol display area in the designated set of the symbol display areas, the gaming system replaces the symbol of the first set of symbols displayed at that symbol display area with a Wild symbol.

In certain embodiments, the partial reel re-spin feature also includes an expanding Wilds feature. In one such embodiment, when the gaming system determines a designated set of the symbol display areas upon the occurrence of the triggering event, the gaming system replaces the symbols of the first set displayed at each of a column of the symbol display areas of the designated set (such as the column of the symbol display areas of the designated set including the symbol display area at which the triggering symbol is displayed) with Wild symbols. In another such embodiment, when the gaming system determines a designated set of the symbol display areas upon the occurrence of the triggering event, the gaming system replaces the symbols of the first set displayed at each of a row of the symbol display areas of the designated set (such as the row of the symbol display areas of the designated set including the symbol display area at which the triggering symbol is displayed) with Wild symbols. In another such embodiment, when the gaming system determines a designated set of the symbol display areas upon the occurrence of the triggering event, the gaming system replaces the symbols of the first set displayed at each of a column of the symbol display areas (such as the column of the symbol display areas including the symbol display area at which the triggering symbol is displayed) with Wild symbols. In another such embodiment, when the gaming system determines a designated set of the symbol display areas upon the occurrence of the triggering event, the gaming system replaces the symbols of the first set displayed at each of a row of the symbol display areas (such as the row of the symbol display areas including the symbol display area at which the triggering symbol is displayed) with Wild symbols.

In various embodiments, the gaming system provides the player an award (such as an award or monetary credits or any other suitable award) upon an occurrence of the triggering event in addition to providing the partial reel re-spin feature. In one such embodiment, the gaming system determines the award based on the size of the designated set of the symbol display areas (e.g., based on how many symbol display areas are included in the designated set).

As noted above, in certain embodiments, for a particular designated set of the plurality of symbol display areas, the second set of reels that the gaming system employs to determine and display symbols of the second set at the symbol display areas of the designated set is the same as the first set of reels that the gaming system employed to determine and display symbols of the first set at those symbol display areas of the designated set.

In other embodiments, for a particular designated set of the plurality of symbol display areas, the gaming system determines the second set of reels that the gaming system employs to determine and display symbols of the second set at the symbol display areas of the designated set based on the symbols of the first set displayed at the symbol display areas of the designated set of the symbol display areas. For instance, in one example embodiment, for a particular designated set of the symbol display areas, the gaming system determines the second set of reels by, for each column of symbol display areas of that designated set, determining a reel including only the symbols displayed at the symbol display areas of that column. Thus, in this example embodiment, each column of symbol display areas in a particular designated set of the symbol display areas is associated with a reel in the second set of reels that includes only the symbols of the first set originally displayed at the symbol display areas of that particular column.

Figure 9A:
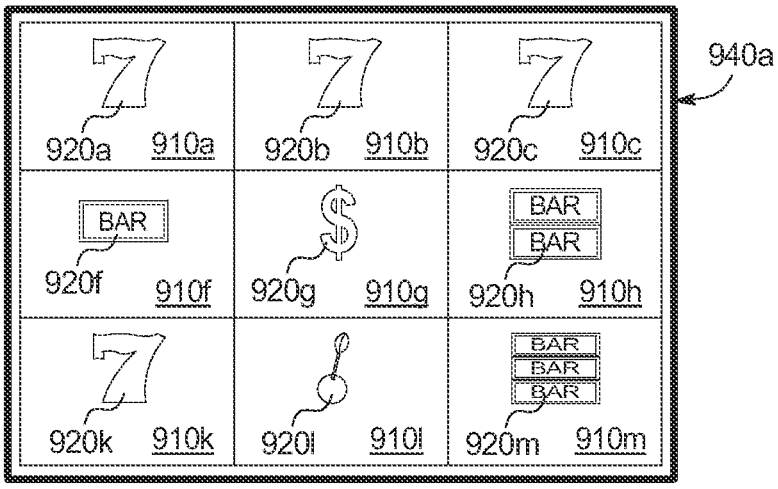
FIG. 9A illustrates a screen shot of another example embodiment of the gaming system of the present disclosure providing the slot game having the partial reel re-spin feature.
Figure 9B:
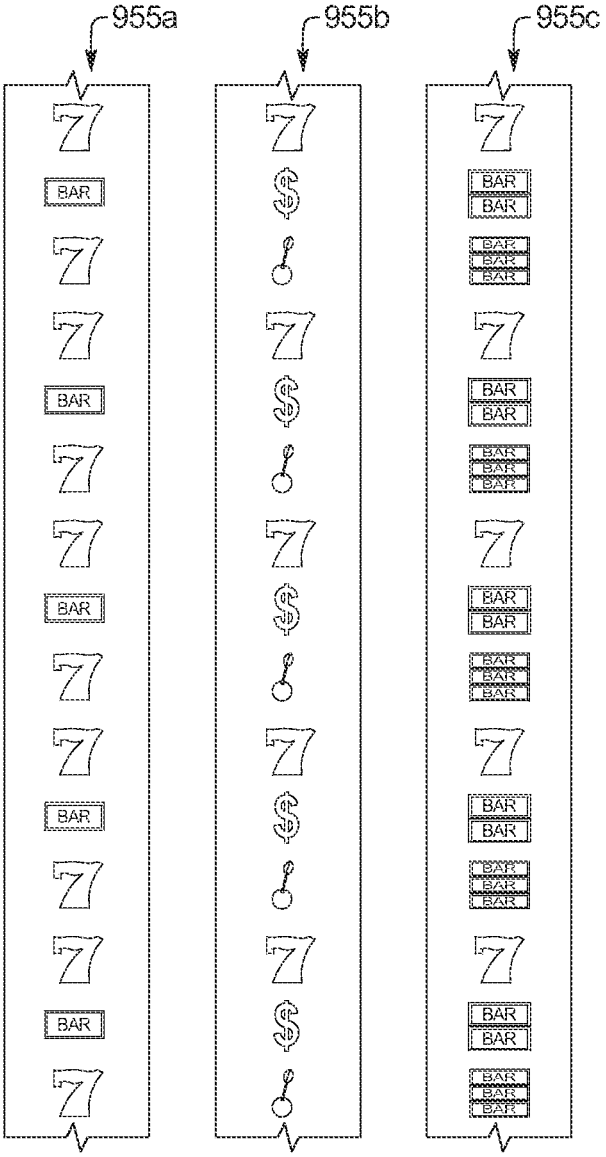
FIGS. 9B and 9C illustrate example reels of the second set of reels employed to display symbols at the designated set of the symbol display areas.

FIGS. 9A and 9B illustrate screen shots of one such example embodiment of the gaming system of the present disclosure. Specifically, FIG. 9A illustrates a designated set of the symbol display areas including the symbol display areas 910*a*, 910*b*, 910*c*, 910*f*, 910*g*, 910*h*, 910*k*, 910*l*, and 910*m* respectively displaying Seven symbol 920*a*, Seven symbol 920*b*, Seven symbol 920*c*, Bar symbol 920*f*, Dollar Sign symbol 920*g*, Double Bar symbol 920*h*, Seven symbol 920*k*, Cherry symbol 920*l*, and Triple Bar symbol 920*m*. In this example embodiment, as shown in FIG. 9B, the gaming system determines a second set of reels including: (a) a reel 955*a* that includes the symbols 920*a*, 920*f*, and 920*k* displayed at the symbol display areas 910*a*, 910*f*, and 910*k* and associates the reel 955*a* with those symbol display areas; (b) a reel 955*b* that includes the symbols 920*b*, 920*g*, and 920*l* displayed at the symbol display areas 910*b*, 910*g*, and 910*l* and associates the reel 955*b* with those symbol display areas; and (c) a reel 955*c* that includes the symbols 920*c*, 920*h*, and 920*m* displayed at the symbol display areas 910*c*, 910*h*, and 910*m* and associates the reel 955*c* with those symbol display areas.

In another example embodiment, for a particular designated set of the symbol display areas, the gaming system determines the second set of reels by, for each column of symbol display areas of that designated set, creating a reel including only the symbols displayed at the symbol display areas of the designated set. Thus, in this example embodiment, each column of symbol display areas in a particular designated set of the symbol display areas is associated with a reel in the second set of reels that includes only the symbols of the first set originally displayed at the symbol display areas of the designated set.

Figure 9C:
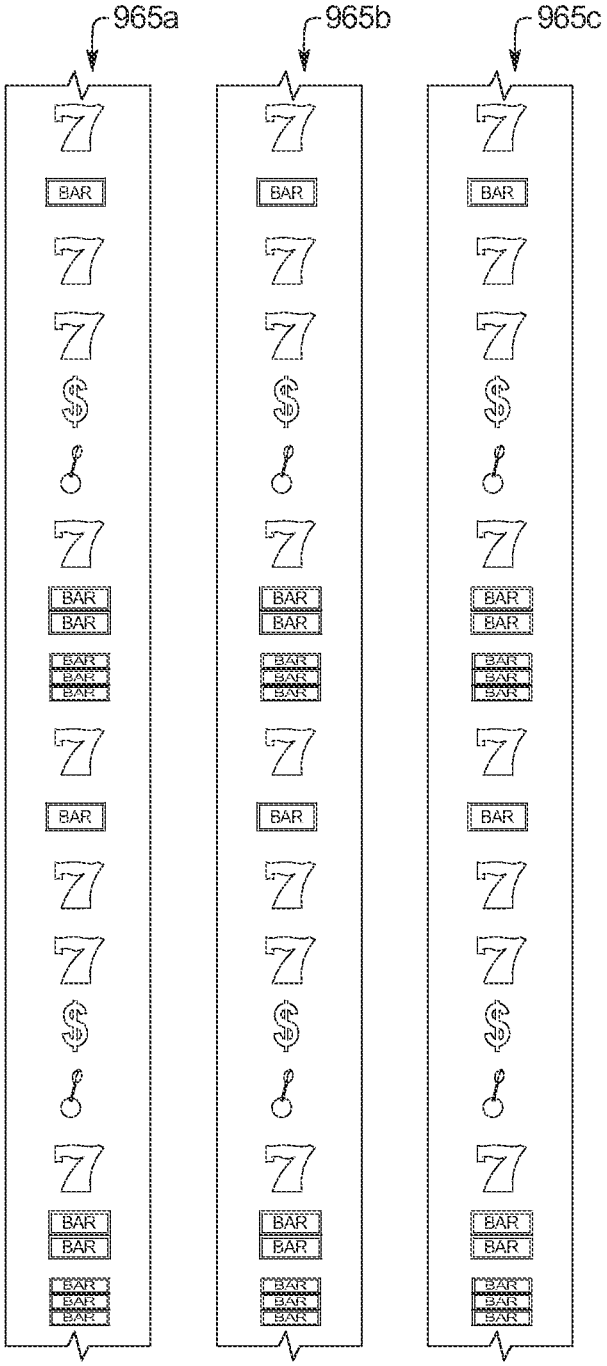

FIGS. 9A and 9C illustrate screen shots of one such example embodiment of the gaming system of the present disclosure. Specifically, FIG. 9A illustrates a designated set of the symbol display areas including the symbol display areas 910*a*, 910*b*, 910*c*, 910*f*, 910*g*, 910*h*, 910*k*, 910*l*, and 910*m* respectively displaying Seven symbol 920*a*, Seven symbol 920*b*, Seven symbol 920*c*, Bar symbol 920*f*, Dollar Sign symbol 920*g*, Double Bar symbol 920*h*, Seven symbol 920*k*, Cherry symbol 920*l*, and Triple Bar symbol 920*m*. In this example embodiment, as shown in FIG. 9C, the gaming system determines a second set of reels including: (a) a reel 965*a* that includes the symbols 920*a*, 920*b*, 920*c*, 920*f*, 920*g*, 920*h*, 920*k*, 920*l*, and 920*m* displayed at the symbol display areas of the designated set and associates the reel 965*a* with the symbol display areas 910*a*, 910*f*, and 910*k*; (b) a reel 965*b* identical to the reel 965*a* and associates the reel 965*b* with the symbol display areas 910*b*, 910*g*, and 910*l*; and (c) a reel 965*c* that is identical to the reel 965*a* and associates the reel 965*c* with the symbol display areas 910*c*, 910*h*, and 910*m*.

In further embodiments, for a particular designated set of the plurality of symbol display areas, the gaming system determines the second set of reels that the gaming system employs to determine and display symbols of the second set at the symbol display areas of the designated set based on the symbols of the first set displayed at the symbol display areas of the designated set of the symbol display areas and a desired hit frequency and average expected payback percentage. For instance, in one example embodiment, for a particular designated set of the symbol display areas, the gaming system determines the second set of reels by, for each column of symbol display areas of that designated set, determining a reel including the symbols displayed at the symbol display areas of that column and one or more additional symbols such that the hit frequency of that reel approaches the desired hit frequency and the average expected payback percentage approaches the desired average expected payback percentage.

In certain embodiments, for a particular designated set of the symbol display areas, the gaming system replaces the symbols displayed at the symbol display areas of the designated set more than once and provides more than one additional award evaluations. For instance, in one example embodiment, the gaming system determines how many times to replace the symbols displayed at the symbol display areas of the designated set (such as by spinning and stopping a second set of reels in association with the symbol display areas of the designated set) and how many additional award evaluations to provide based on the quantity of displayed triggering symbols. In this example embodiment, each displayed triggering symbol represents one spin of the second set of reels (e.g., if two triggering symbols are displayed, the gaming system spins the reels of the second set twice and provides two additional award determinations).

In various embodiments, instead of (or in addition to) evaluating the symbols displayed at all of the symbol display areas after replacing the symbols of the first set of symbols displayed at the symbol display areas of a designated set of the symbol display areas with symbols of the second set of symbols, the gaming system evaluates only the symbols displayed at the symbol display areas of that designated set. In certain such embodiments, the gaming system does so using a different paytable.

In various embodiments in which the gaming system replaces the symbols of the first set displayed at the symbol display areas of a designated set of the symbol display areas by spinning and stopping a second set of reels in association with the designated set of the symbol display areas, the gaming system employs any suitable spin feature such as, but not limited to: (a) reverse-spinning reels (e.g., spinning bottom-to-top instead of top-to-bottom); (b) locking reels; (c) sideways spinning reels (e.g., left-to-right spin or right-to-left spin); (d) increased spin speed; (e) forward-spinning reels and reverse-spinning reels; and/or (f) additional reel animations (e.g., a sparkle, blur, or wobble effect).

In certain embodiments, after the gaming system replaces the symbols of the first set of symbols displayed at the symbol display areas of the designated set of the symbol display areas with symbols of the second set of symbols, the gaming system repeats the process if another triggering symbol is displayed at one of the symbol display areas of the designated set.

In various embodiments, if the triggering event occurs, the gaming system does not make any award determinations until after the gaming system provides the partial reel re-spin feature.

In certain embodiments, upon an occurrence of the triggering event, the gaming system randomly determines whether to provide a play of a bonus game. In certain such embodiments, if the triggering event occurs, the gaming system displays a plurality of bonus reels and spins and stops the displayed bonus reels. If the symbols displayed on the stopped bonus reels form a bonus triggering combination, the gaming system provides a play of the bonus game. In one such embodiment, the triggering event occurs if a designated symbol or a designated symbol combination is displayed. For instance, in one example embodiment, when the designated symbol is displayed following a spin of the first set of reels, the gaming system zooms in on the designated symbol, displays the plurality of bonus reels, and spins and stops the displayed plurality of bonus reels to determine whether to provide a play of the bonus game.

In certain embodiments, upon an occurrence of the triggering event, the gaming system randomly determines one of a plurality of guaranteed bonus awards to provide the player. In certain such embodiments, if the triggering event occurs, the gaming system displays a plurality of bonus reels and spins and stops the displayed bonus reels. The gaming system provides a guaranteed bonus award associated with the symbols displayed on the stopped bonus reels. In one such embodiment, the triggering event occurs if a designated symbol or a designated symbol combination is displayed. For instance, in one example embodiment, when the designated symbol is displayed following a spin of the first set of reels, the gaming system zooms in on the designated symbol, displays the plurality of bonus reels, and spins and stops the displayed plurality of bonus reels to determine the guaranteed bonus award.

It should be appreciated that:

(a) the manner in which the gaming system determines the quantity of symbol display areas to include in a particular designated set of the symbol display areas;
the manner in which the gaming system determines which particular symbol display areas to include in a particular designated set of the symbol display areas;
the quantity of symbol display areas included in a particular designated set of the symbol display areas;
the particular symbol display areas included in a particular designated set of the symbol display areas;
the occurrence of the triggering event;
the quantity of symbol display areas for the slot game;
the manner in which the symbol display areas of the slot game are arranged;
the symbols included in the first set of symbols;
the symbols included in the second set of symbols;
the manner in which the gaming system determines the second set of reels; and/or
any other variables and determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM; (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 10A:
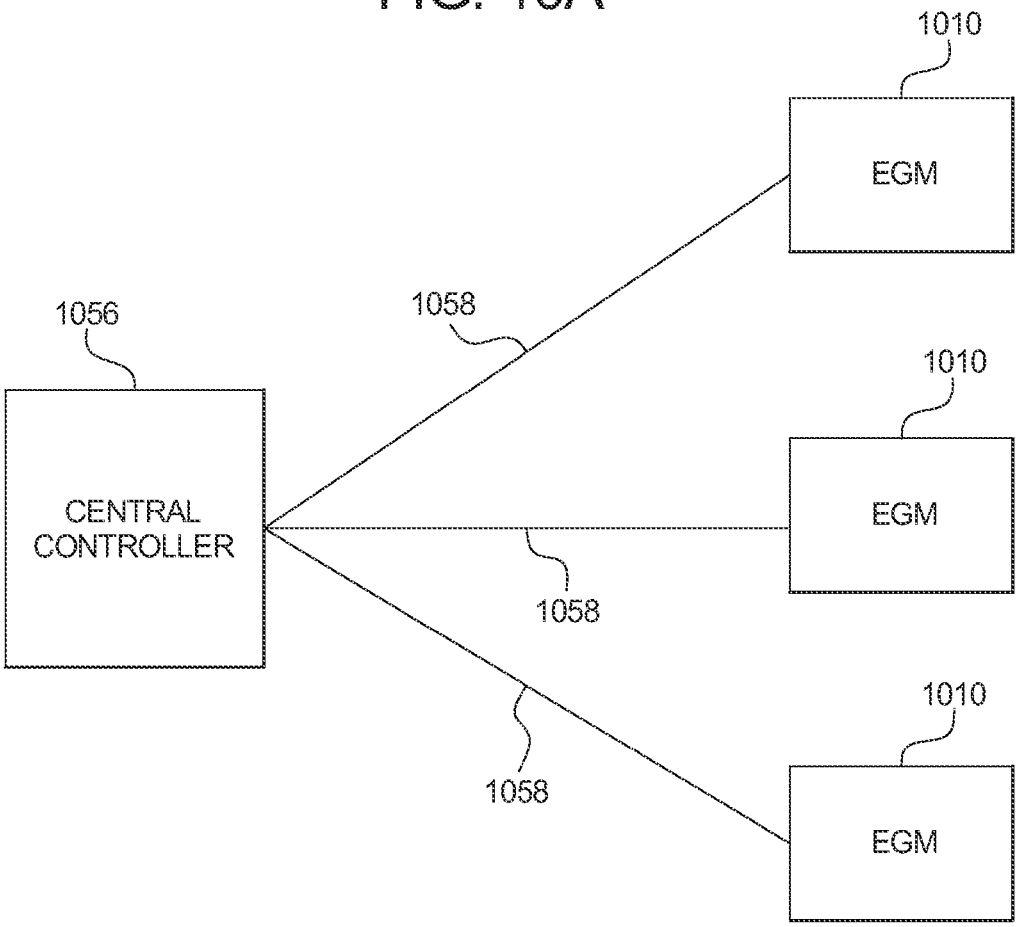
FIG. 10A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 10A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 10B:
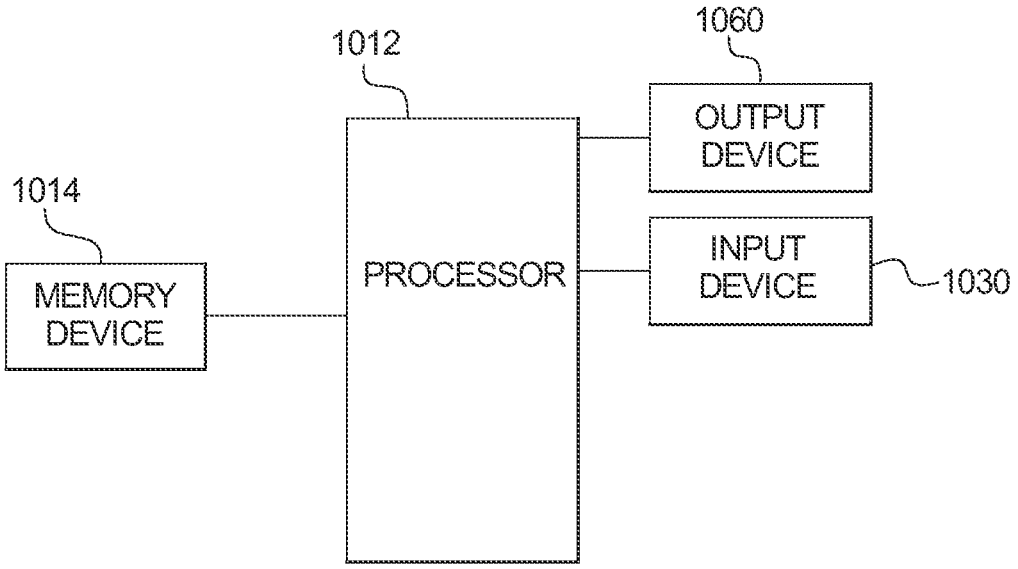
FIG. 10B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 10B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 10B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 11A:
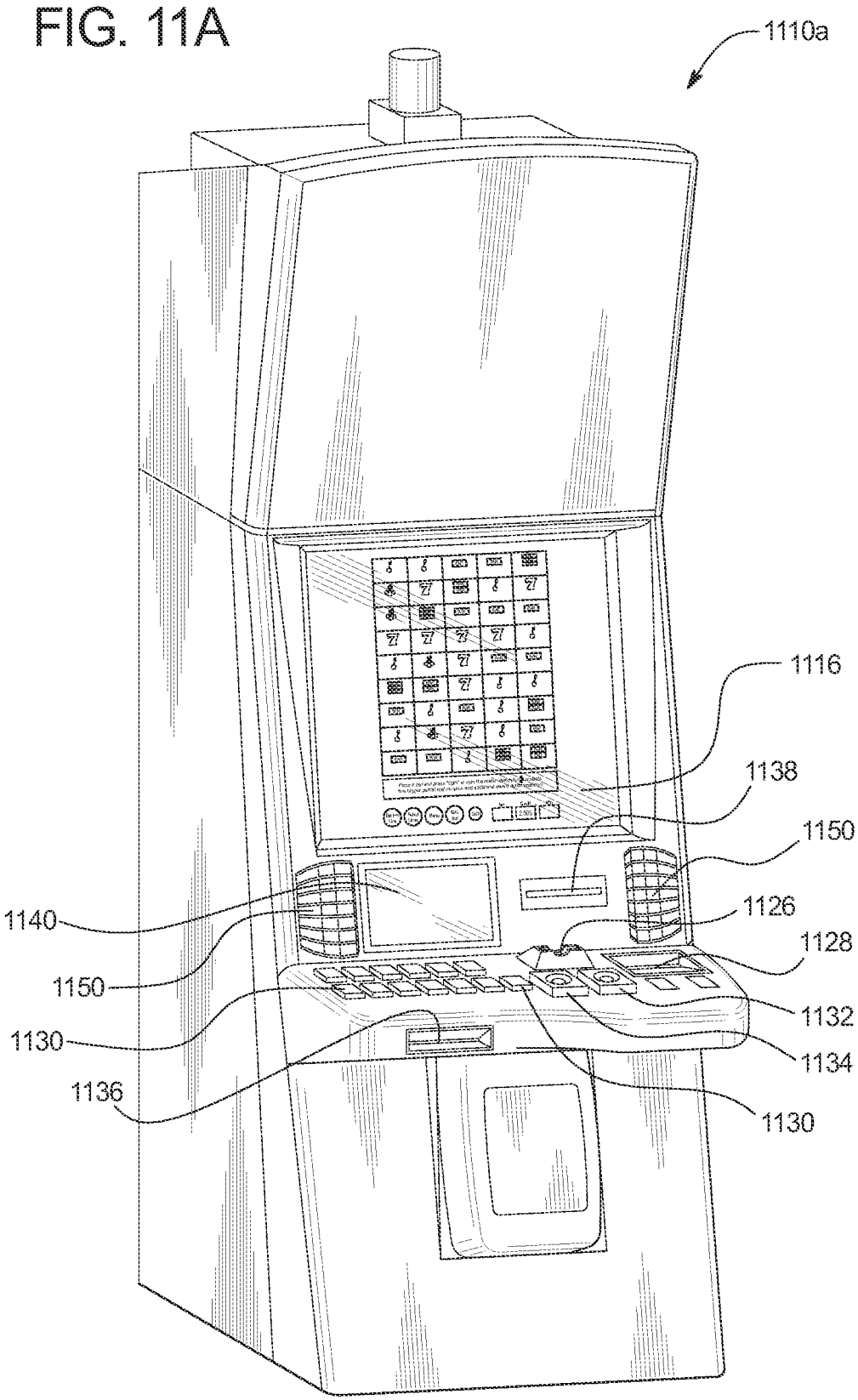
FIGS. 11A and 11B are perspective views of example alternative embodiments of the gaming system of the present disclosure.
Figure 11B:
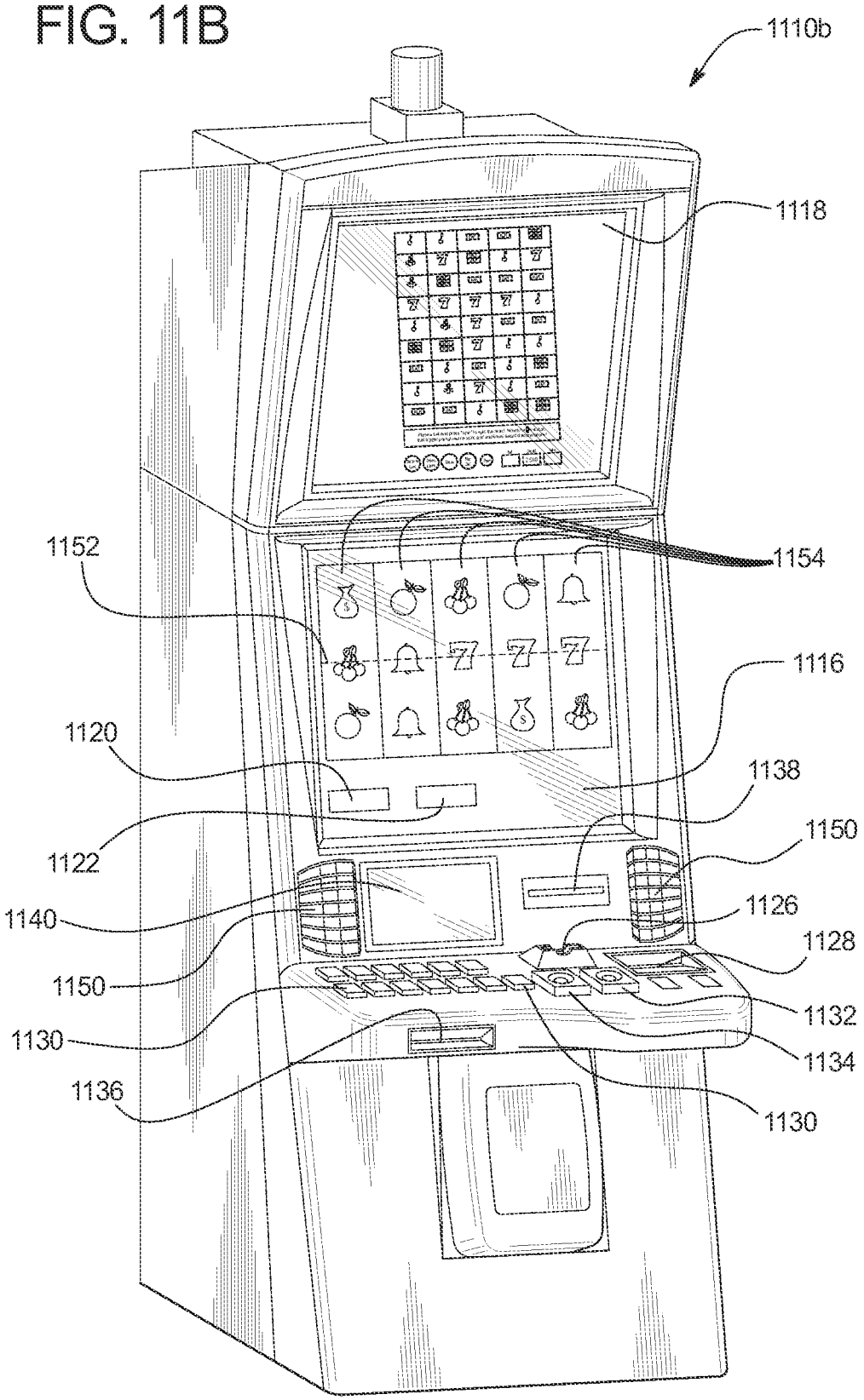

In various embodiments, the EGM includes one or more input devices. The input devices may include any suitable device that enables an input signal to be produced and received by the at least one processor of the EGM. The example EGM illustrated in FIG. 10B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 11A and 11B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 11A and 11B each include a game play activation device in the form of a game play initiation button 1132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 11A and 11B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 11A and 11B each include a card reader 1138. The card reader is configured to read a player identification card inserted into the card reader.

In various embodiments, the EGM includes one or more output devices. The example EGM illustrated in FIG. 10B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 11A includes a central display device 1116, a player tracking display 1140, a credit display 1120, and a bet display 1122. The example EGM illustrated in FIG. 11B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 11A and 11B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 11A and 11B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 11A and 11B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 11A and 11B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

at least one processor;

at least one display device supported by the housing;

a plurality of input devices supported by the housing and including an acceptor; and at least one memory device that stores a plurality of instructions which, when executed by the at least one processor, cause the at least one processor to:

establish a credit balance based at least in part on a monetary value associated with a physical item following receipt of the physical item by the acceptor;

place a wager following receipt of a wager input via one of the input devices, the credit balance being decreasable by the wager;

cause the at least one display device to display a plurality of symbol display areas;

for a play of a game, for each symbol display area, cause the at least one display device to display a randomly determined symbol of a first set of a plurality of symbols at said symbol display area, the first set of symbols including a triggering symbol;

responsive to the triggering symbol being displayed at one of the symbol display areas:

determine a designated set of a plurality of the symbol display areas based at least in part on a proximity of each other symbol display area to the symbol display area at which said triggering symbol is displayed;

for each symbol display area of the designated set of the symbol display areas: (1) randomly determine whether to replace the symbol of the first set of symbols displayed at said symbol display area with a designated symbol; (2) responsive to determining to replace the symbol of the first set of symbols displayed at said symbol display area with the designated symbol, cause the at least one display device to replace the symbol of the first set of symbols displayed at said symbol display area with the designated symbol; and (3) responsive to determining not to replace the symbol of the first set of symbols displayed at said symbol display area with the designated symbol, cause the at least one display device to replace the symbol of the first set of symbols displayed at said symbol display area with a randomly determined symbol of a second set of one or more symbols;

determine any awards based on the displayed symbols and the wager; and cause the at least one display device to display any determined awards, the credit balance increasable by any determined awards; and initiate a payout associated with the credit balance following receipt of a cashout input via one of the input devices.

2. The gaming system of claim 1, wherein the plurality of instructions, when executed by the at least one processor, cause the at least one processor to cause the at least one display device to, for each symbol display area, display a randomly determined symbol of the first set of symbols at said symbol display area by causing the at least one display device to display a first set of a plurality of reels spinning and stopping in association with the symbol display areas.

3. The gaming system of claim 2, wherein the plurality of instructions, when executed by the at least one processor, cause the at least one processor to cause the at least one display device to, for each symbol display area of the designated set of the symbol display areas, responsive to determining not to replace the symbol of the first set of symbols displayed at said symbol display area with the designated symbol, replace the symbol of the first set of symbols displayed at said symbol display area with a randomly determined symbol of a second set of one or more symbols by causing the at least one display device to display a second set of a plurality of reels spinning and stopping in association with the symbol display areas of the designated set of the symbol display areas.

4. The gaming system of claim 3, wherein the first set of reels and the second set of reels are the same.

5. The gaming system of claim 1, wherein the first set of symbols and the second set of symbols are the same.

6. The gaming system of claim 1, wherein the plurality of instructions, when executed by the at least one processor, cause the at least one processor to determine the second set of symbols based, at least in part, on the symbols of the first set of symbols displayed at the symbol display areas of the designated set of the symbol display areas.

7. A method of operating a gaming system, said method comprising:

receiving, by an acceptor, a physical item associated with a monetary value;

establishing, by at least one processor, a credit balance based at least in part on the monetary value associated with the received physical item;

receiving a wager input via at least one input device;

placing, by the at least one processor, a wager in response to the received wager input, the credit balance decreasable by the wager;

causing, by the at least one processor, at least one display device to display a plurality of symbol display areas;

for a play of a game, for each symbol display area, causing, by the at least one processor, the at least one display device to display a randomly determined symbol of a first set of a plurality of symbols at said symbol display area, the first set of symbols including a triggering symbol;

responsive to the triggering symbol being displayed at one of the symbol display areas:

determining, by the at least one processor, a designated set of a plurality of the symbol display areas based at least in part on a proximity of each other symbol display area to the symbol display area at which said triggering symbol is displayed;

for each symbol display area of the designated set of the symbol display areas: randomly determining, by the at least one processor, whether to replace the symbol of the first set of symbols displayed at said symbol display area with a designated symbol; responsive to determining to replace the symbol of the first set of symbols displayed at said symbol display area with the designated symbol, causing, by the at least one processor, the at least one display device to replace the symbol of the first set of symbols displayed at said symbol display area with the designated symbol; and responsive to determining not to replace the symbol of the first set of symbols displayed at said symbol display area with the designated symbol, causing, by the at least one processor, the at least one display device to replace the symbol of the first set of symbols displayed at said symbol display area with a randomly determined symbol of a second set of one or more symbols;

determining, by the at least one processor, any awards based on the displayed symbols and the wager; and causing, by the at least one processor, the at least one display device to display any determined awards, the credit balance increasable by any determined awards;

receiving a cashout input via the at least one input device; and initiating, by the at least one processor, a payout associated with the credit balance in response to the received cashout input.

8. The method of claim 7, which includes, for each symbol display area, causing, by the at least one processor, the at least one display device to display a randomly determined symbol of the first set of symbols at said symbol display area by causing the at least one display device to display a first set of a plurality of reels spinning and stopping in association with the symbol display areas.

9. The method of claim 8, which includes, for each symbol display area of the designated set of the symbol display areas, responsive to determining not to replace the symbol of the first set of symbols displayed at said symbol display area with the designated symbol, causing, by the at least one processor, the at least one display device to replace the symbol of the first set of symbols displayed at said symbol display area with a randomly determined symbol of a second set of one or more symbols by causing the at least one display device to display of a second set of a plurality of reels spinning and stopping in association with the symbol display areas of the designated set of the symbol display areas.

10. The method of claim 9, wherein the first set of reels and the second set of reels are the same.

11. The method of claim 7, wherein the first set of symbols and the second set of symbols are the same.

12. The method of claim 7, which includes determining, by the at least one processor, the second set of symbols based, at least in part, on the symbols of the first set of symbols displayed at the symbol display areas of the designated set of the symbol display areas.

13. The method of claim 7, which is at least partially provided through a data network.

14. The method of claim 13, wherein the data network is an internet.

15. The gaming system of claim 1, wherein the determined awards are second awards, and wherein the plurality of instructions, when executed by the at least one processor, cause the at least one processor to, before replacing any symbols of the first set of symbols, determine any first awards based on the displayed symbols and the wager, and cause the at least one display device to display any determined second awards.

16. The method of claim 7, wherein the determined awards are second awards, and which includes, before replacing any symbols of the first set of symbols, determining, by the at least one processor, any first awards based on the displayed symbols and the wager, and causing, by the at least one processor, the at least one display device to display any determined second awards.

17. The gaming system of claim 1, wherein the designated symbol is a Wild symbol.

18. The method of claim 7, wherein the designated symbol is a Wild symbol.

19. A gaming system comprising:

at least one processor; and at least one memory device that stores a plurality of instructions which, when executed by the at least one processor, cause the at least one processor to:

cause at least one display device to display a plurality of symbol display areas;

for a play of a game, for each symbol display area, cause the at least one display device to display a randomly determined symbol of a first set of a plurality of symbols at said symbol display area, the first set of symbols including a triggering symbol; and responsive to the triggering symbol being displayed at one of the symbol display areas:

determine a designated set of a plurality of the symbol display areas based at least in part on a proximity of each other symbol display area to the symbol display area at which said triggering symbol is displayed;

for each symbol display area of the designated set of the symbol display areas: (1) randomly determine whether to replace the symbol of the first set of symbols displayed at said symbol display area with a designated symbol; (2) responsive to determining to replace the symbol of the first set of symbols displayed at said symbol display area with the designated symbol, cause the at least one display device to replace the symbol of the first set of symbols displayed at said symbol display area with the designated symbol; and (3) responsive to determining not to replace the symbol of the first set of symbols displayed at said symbol display area with the designated symbol, cause the at least one display device to replace the symbol of the first set of symbols displayed at said symbol display area with a randomly determined symbol of a second set of one or more symbols;

determine any awards based on the displayed symbols; and cause the at least one display device to display any determined awards.

20. The gaming system of claim 19, wherein the plurality of instructions, when executed by the at least one processor, cause the at least one processor to cause the at least one display device to, for each symbol display area, display a randomly determined symbol of the first set of symbols at said symbol display area by causing the at least one display device to display a first set of a plurality of reels spinning and stopping in association with the symbol display areas.

21. The gaming system of claim 20, wherein the plurality of instructions, when executed by the at least one processor, cause the at least one processor to cause the at least one display device to, for each symbol display area of the designated set of the symbol display areas, responsive to determining not to replace the symbol of the first set of symbols displayed at said symbol display area with the designated symbol, replace the symbol of the first set of symbols displayed at said symbol display area with a randomly determined symbol of a second set of one or more symbols by causing the at least one display device to display a second set of a plurality of reels spinning and stopping in association with the symbol display areas of the designated set of the symbol display areas.

22. The gaming system of claim 21, wherein the first set of reels and the second set of reels are the same.

23. The gaming system of claim 19, wherein the first set of symbols and the second set of symbols are the same.

24. The gaming system of claim 19, wherein the plurality of instructions, when executed by the at least one processor, cause the at least one processor to determine the second set of symbols based, at least in part, on the symbols of the first set of symbols displayed at the symbol display areas of the designated set of the symbol display areas.

25. The gaming system of claim 19, wherein the determined awards are second awards, and wherein the plurality of instructions, when executed by the at least one processor, cause the at least one processor to, before replacing any symbols of the first set of symbols, determine any first awards based on the displayed symbols and cause the at least one display device to display any determined second awards.

26. The gaming system of claim 19, wherein the at least one display device is part of a mobile device.

* * * * *